US010786845B2

(12) United States Patent
Vulcan et al.

(10) Patent No.: US 10,786,845 B2
(45) Date of Patent: Sep. 29, 2020

(54) ACTUATOR DEVICE

(71) Applicant: Hatebur Umformmaschinen AG, Reinach (CH)

(72) Inventors: Mihai Vulcan, Hofstetten (CH); Bernhard Zervas, Ammerbuch (DE)

(73) Assignee: Hatebur Umformmaschinen AG, Reinach (CH)

( * ) Notice: Subject to any disclaimer, the term of this patent is extended or adjusted under 35 U.S.C. 154(b) by 264 days.

(21) Appl. No.: 15/772,320

(22) PCT Filed: Oct. 26, 2016

(86) PCT No.: PCT/EP2016/075798

§ 371 (c)(1),
(2) Date: Apr. 30, 2018

(87) PCT Pub. No.: WO2017/072173

PCT Pub. Date: May 4, 2017

(65) Prior Publication Data

US 2018/0318901 A1 Nov. 8, 2018

(30) Foreign Application Priority Data

Oct. 29, 2015 (CH) ..... 1582/15

(51) Int. Cl.
*F15B 11/036* (2006.01)
*B21D 24/14* (2006.01)
(Continued)

(52) U.S. Cl.
CPC ..... *B21D 24/14* (2013.01); *B21D 45/02* (2013.01); *B21J 5/02* (2013.01); *B21J 13/14* (2013.01);
(Continued)

(58) Field of Classification Search
CPC ..... F15B 11/022; F15B 15/1409; F15B 2211/775; F15B 2211/6336; B21D 24/14; B21D 45/02; B21J 13/14
See application file for complete search history.

(56) References Cited

U.S. PATENT DOCUMENTS 4,208,879 A 6/1980 Segawa
4,499,750 A 2/1985 Gerber et al.
(Continued)

FOREIGN PATENT DOCUMENTS

CN 201871601 U 6/2011
CN 104235114 A 12/2014
(Continued)

*Primary Examiner* — Thomas E Lazo
(74) *Attorney, Agent, or Firm* — The Webb Law Firm

(57) ABSTRACT

An actuator device includes two drive units for an actuator output element. The first drive unit has a first piston chamber and a first piston displaceable therein and also first hydraulic means for displacing the piston. The second drive unit has a second piston chamber and a second piston displaceable therein and also second hydraulic or pneumatic means for displacing the piston. The second piston is joined to the actuator output element for conjoint movement therewith and can be coupled to the first piston for thrust, so that the second piston is displaceable in an outward direction by the first piston. The first drive unit is configured for a larger thrust force than the second drive unit, while the second drive unit is designed for a greater stroke speed than the first drive unit.

20 Claims, 26 Drawing Sheets

(51) Int. Cl.

| | |
|---|---|
| ***B21D 45/02*** | (2006.01) |
| ***B21J 13/14*** | (2006.01) |
| ***B21J 5/02*** | (2006.01) |
| ***F15B 15/14*** | (2006.01) |
| ***B30B 15/16*** | (2006.01) |
| ***F15B 11/02*** | (2006.01) |
| ***B30B 1/32*** | (2006.01) |

(52) U.S. Cl.

CPC ..... *B30B 1/32* (2013.01); *B30B 1/323* (2013.01); *B30B 15/161* (2013.01); *B30B 15/163* (2013.01); *B30B 15/165* (2013.01); *F15B 11/022* (2013.01); *F15B 11/0365* (2013.01); *F15B 15/1409* (2013.01); *F15B 2211/20576* (2013.01); *F15B 2211/212* (2013.01); *F15B 2211/625* (2013.01); *F15B 2211/6336* (2013.01); *F15B 2211/7056* (2013.01); *F15B 2211/775* (2013.01)

(56) References Cited

U.S. PATENT DOCUMENTS

| | | | | |
|---|---|---|---|---|
| 6,354,082 | B1 * | 3/2002 | Brieschke | F15B 11/0325 60/547.1 |
| 6,474,215 | B1 | 11/2002 | Boyer et al. | |
| 9,038,431 | B2 * | 5/2015 | Micklisch | F15B 11/036 72/351 |
| 9,488,199 | B2 * | 11/2016 | Nellessen | F15B 11/0365 |
| 9,512,860 | B2 * | 12/2016 | Horikawa | F16J 10/02 |
| 2014/0366716 | A1 | 12/2014 | Horikawa et al. | |

FOREIGN PATENT DOCUMENTS

| | | | |
|---|---|---|---|
| DE | 2845092 | A1 | 4/1980 |
| EP | 0074421 | A1 | 3/1983 |
| EP | 1398105 | A1 | 3/2004 |
| EP | 2813735 | A1 | 12/2014 |
| FR | 2781016 | A1 | 1/2000 |
| WO | 2010118799 | A1 | 10/2010 |

* cited by examiner

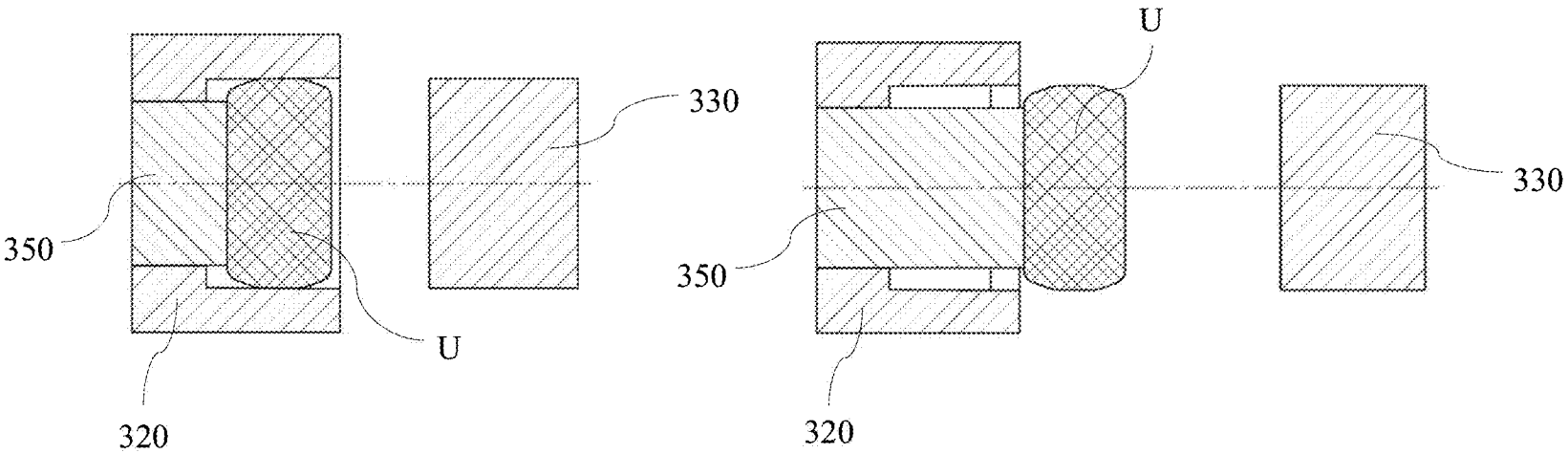
Fig. 24
Fig. 23
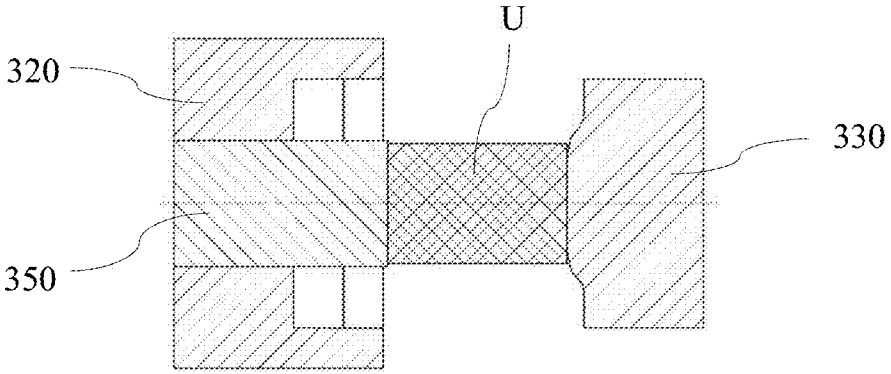
Fig. 25

ACTUATOR DEVICE

CROSS-REFERENCE TO RELATED APPLICATIONS

This application is the United States national phase of International Application No. PCT/EP2016/075798 filed Oct. 26, 2016, and claims priority to Switzerland Patent Application No. 1582/15 filed Oct. 29, 2015, the disclosures of which are hereby incorporated in their entirety by reference.

BACKGROUND OF THE INVENTION

Field of the Invention

The present invention relates to an actuator device for linear movement of an actuator output element along a movement axis. The invention relates also to a use of the actuator device.

Description of Related Art

During the process of shaping a deformable material in a forming device it is often necessary, on the one hand, to support the deformable material against movement or to brake a process-related displacement of the deformable material in a controlled way and, on the other hand, to eject the finished shaped material from a forming die. In some cases relatively large supporting and ejecting forces are required for that purpose. On the other hand, at least the ejection of the deformable material should take place at high speed so as to ensure a high machine cycle rate of the forming device.

WO 2010/118799 A1 describes a device for ejecting shaped parts from a forming die of a forming device. The ejecting device comprises two coupled drive units, of which one applies the relatively large release force required for releasing the shaped parts from the forming die, while the other performs the actual ejecting movement with a smaller ejection force but at a considerably higher speed. In one arrangement the drive unit responsible for applying the release force comprises a hydraulic cylinder in which a piston having a narrowly defined stroke length is displaceably mounted. The piston acts upon a rod-shaped ejector pin which breaks the shaped part away from the forming die. The drive unit for the actual ejecting movement comprises an electric motor drive which effects further movement of the ejector pin, the shaped part then being fully ejected from the forming die. The stroke length of that drive unit is substantially greater than the piston stroke length of the hydraulic drive unit. The electric motor drive can be a linear motor direct drive or a servo motor which is connected to the ejector pin, for example, by means of a rack and pinion connection.

That known ejecting device is not suitable for supporting a shaped part in the forming die during the forming operation or for braking the process-related displacement of the shaped part in a controlled way during the forming operation.

A problem underlying the present invention is therefore to provide an actuator device of the generic kind which is suitable both for moving an object and for supporting an object against undesirable deflected movements when acted upon by an external force, and also for controlled braking of an object in the event of its being displaced as a result of the action of an external force.

SUMMARY OF THE INVENTION

That problem is solved by the actuator device according to the present invention. Preferred uses of the actuator device are described herein.

The essence of the invention lies in the following: an actuator device for linear movement of an actuator output element along a movement axis comprises a first drive unit and a second drive unit. The first drive unit has a first piston chamber and a first piston mounted so as to be linearly displaceable therein and also first hydraulic means for displacing the first piston in the first piston chamber. The second drive unit has the actuator output element which is linearly movable along the movement axis and which can be coupled to the first piston of the first drive unit for thrust, so that by movement of the first piston in an outward direction the actuator output element is likewise moved in the outward direction. The second drive unit has a second piston chamber joined to the first piston chamber for conjoint movement therewith and a second piston mounted so as to be linearly displaceable in the second piston chamber and also second hydraulic or pneumatic means for displacing the second piston in the second piston chamber. The second piston is joined to the actuator output element for conjoint movement therewith, so that by movement of the second piston in the outward direction the actuator output element is movable out of the second piston chamber and by movement of the second piston in an inward direction opposite to the outward direction the actuator output element is movable into the second piston chamber. The actuator device has a position-measuring device for detecting the positions of the first piston and the second piston relative to a reference position that is fixed with respect to the device for a position-controlled movement of the actuator output element.

Because the second drive unit is in the form of a hydraulic or pneumatic piston drive, the actuator device is suitable not only for moving an object but also for supporting and braking an object. The position-measuring device for detecting the positions of the first piston and the second piston relative to a reference position that is fixed with respect to the device makes it possible to effect position-controlled movement of the actuator output element.

Advantageously the first drive unit is configured to generate a larger thrust force than the second drive unit. Conversely, it is advantageous if the second drive unit is configured to accelerate and move the second piston more quickly than the first drive unit accelerates and moves the first piston. In that way it is possible to combine a large thrust force and a rapid advance movement in an optimum way.

Advantageously the actuator device has pressure sensors for detecting the pressures in the first piston chamber and the second piston chamber of hydraulic or pneumatic medium located in the first piston chamber and the second piston chamber. This makes it possible to effect pressure- or force-controlled movement of the actuator output element.

Advantageously the actuator device comprises a control device which co-operates with the position-measuring device and the pressure sensors for the purpose of position- and force-controlled movement of the first piston and the second piston.

Preferably the actuator device has servo valves, which are arranged to be actuated by the control device and are advantageously configured for continuous operation, for supplying and discharging hydraulic or pneumatic medium to and from the first and second piston chambers. By means of the servo valves, the movement of the actuator output element can be controlled precisely and continuously.

Alternatively the actuator device has speed-controlled pumps, which are arranged to be actuated by the control device, for supplying and discharging hydraulic or pneumatic medium to and from the first and second piston chambers.

Advantageously the first drive unit comprises a bladder or diaphragm accumulator for resetting the first piston in the inward direction. In an advantageous alternative arrangement the first drive unit comprises a gas accumulator for resetting the first piston in the inward direction. This makes it possible to return the first piston with very little effort.

Advantageously an impact element is joined to the second piston for conjoint movement therewith, via which impact element the second piston is displaceable in the outward direction by the first piston.

According to a further aspect of the invention, the actuator device is used for applying a directed force to a deformable material in a forming device.

In an advantageous use, the deformable material is ejected from a forming die by the actuator device. In another advantageous use, during a forming process the deformable material is supported by the actuator device against the action of an external force. In a further advantageous use, displacement of the deformable material brought about by the action of an external force is braked in a controlled way by the actuator device.

The actuator device according to the invention is described in greater detail below on the basis of exemplary embodiments and examples of use and referring to the accompanying drawings, wherein:

BRIEF DESCRIPTION OF THE DRAWINGS

FIGS. 23-28—show in diagrammatic form the process sequence of a third application during the descaling and shaping of a shaped part in a forming device;

DESCRIPTION OF THE INVENTION

The following observations apply in respect of the description which follows: where, for the purpose of clarity of the drawings, reference symbols are included in a Figure but are not mentioned in the directly associated part of the description, reference should be made to the explanation of those reference symbols in the preceding or subsequent parts of the description. Conversely, to avoid overcomplication of the drawings, reference symbols that are less relevant for immediate understanding are not included in all Figures. In that case, reference should be made to the other Figures.

Figure 1:
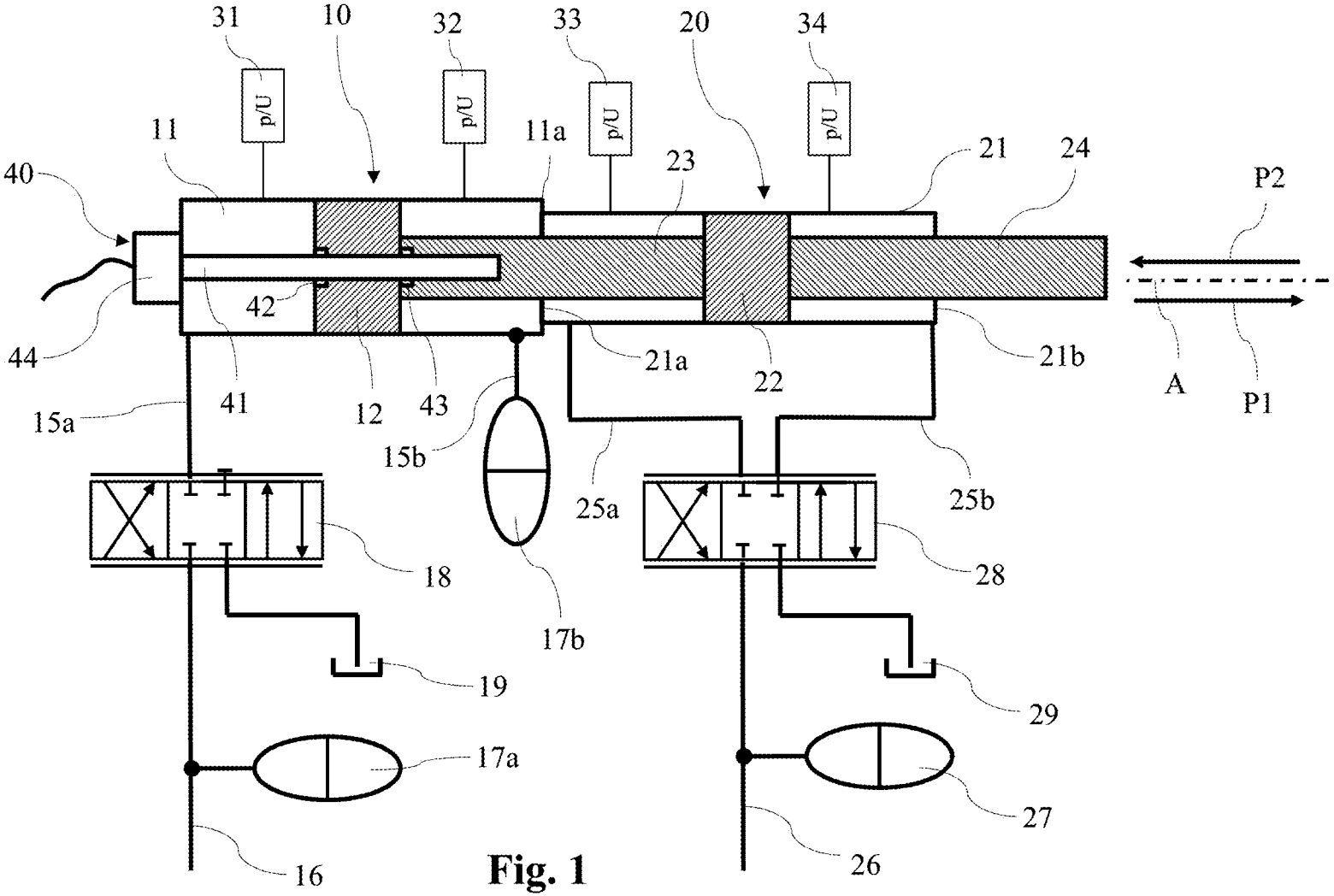
FIG. 1—is a diagrammatic view of an exemplary embodiment of the actuator device according to the invention.
Figure 2:
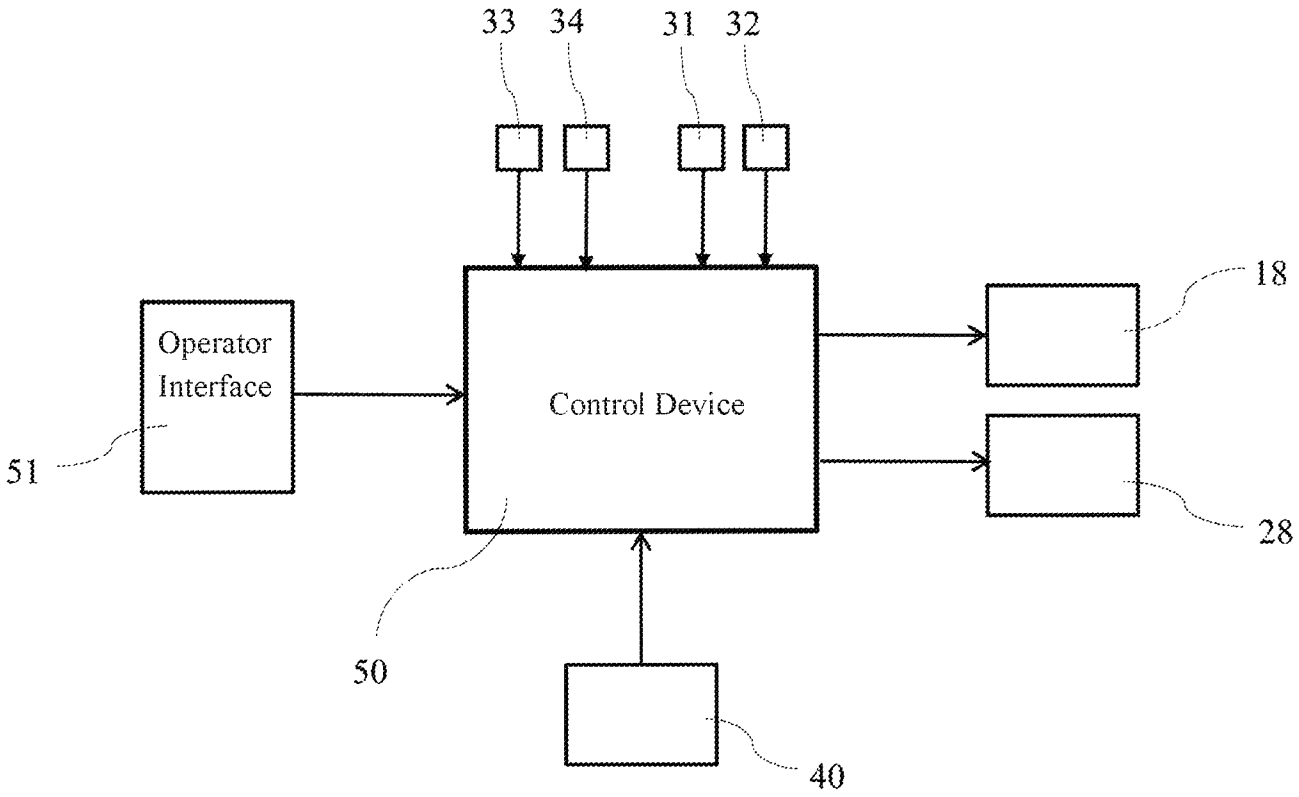
FIG. 2—is a block diagram of a control device of the actuator device of FIG. 1.
Figure 3:
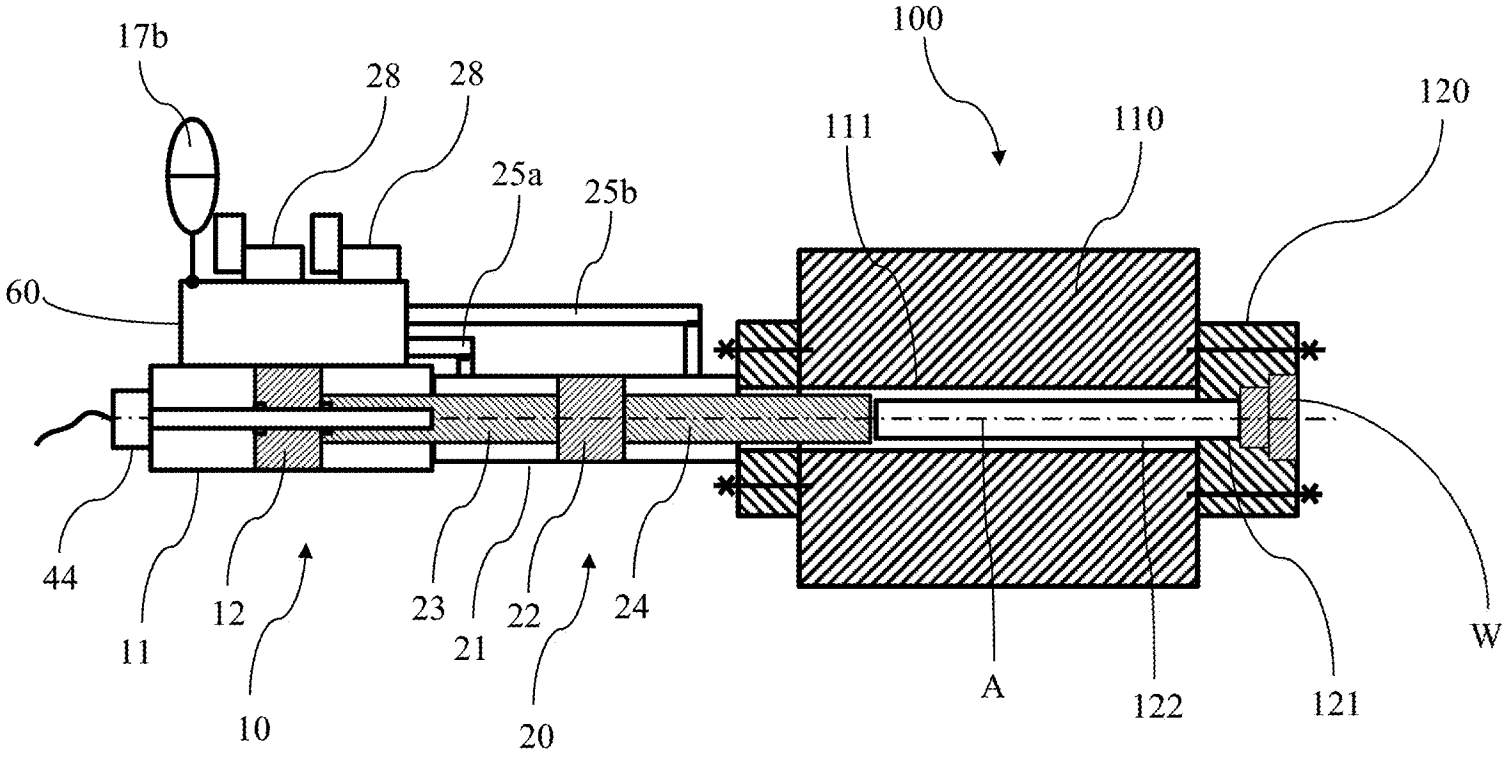
FIG. 3—is a diagrammatic view of the actuator device of FIG. 1 in the context of a forming device.

The exemplary embodiment of the actuator device according to the invention shown with its functionally most important parts in FIGS. 1-3 comprises a first drive unit 10 and a second drive unit 20. The first drive unit 10 comprises a piston chamber 11, for example a cylindrical piston chamber, having a first piston 12 which is mounted so as to be linearly displaceable therein. The second drive unit 20 comprises a piston chamber 21, for example a cylindrical piston chamber, having a second piston 22 mounted so as to be linearly displaceable therein. The two piston chambers 11 and 21 are arranged in alignment one behind the other with respect to a movement axis A and are fixedly joined to one another.

The first piston chamber 11 is connected by way of two lines 15*a* and 15*b* to first hydraulic means which comprise a hydraulic source, which is only symbolised by a line 16, two hydraulic accumulators 17*a* and 17*b*, a first 4-port servo valve 18 configured for continuous operation, and a collecting tank 19. As explained further below, only three of the four ports of the servo valve 18 are used, so that the first servo valve 18 can also be in the form of a 3-port valve. The two lines 15*a* and 15*b* open into the first piston chamber 11 in the region of the two longitudinal ends thereof. The line 15*a* leads to the first servo valve 18. Via the line 15*b* the hydraulic accumulator (bladder or diaphragm accumulator) 17*b* is connected to the first piston chamber 11. On the side of the line 15*a* the operating pressure of the first hydraulic means is up to about 350 bar (high-pressure circuit). On the side of the line 15*b* the operating pressure is substantially lower. The hydraulic accumulator 17*b* is therefore in the form of a low-pressure accumulator. On the side of the line 15*b* it is also possible to use a pneumatic pressure medium instead of a hydraulic medium, in which case a gas accumulator would be provided instead of the hydraulic accumulator 17*b*. This is of advantage if a hydraulic bladder or diaphragm accumulator does not have sufficiently short reaction times for the particular use of the actuator device.

A rod-shaped impact element 23 is joined to the second piston 22 for conjoint movement therewith, which impact element passes, with sealing, through an end wall 21*a* of the second piston chamber 21 and through an adjoining end wall 11*a* of the first piston chamber 11 and projects into the first piston chamber 11. On the side of the second piston 22 opposite the impact element 23 there is mounted for conjoint movement therewith a rod-shaped actuator output element 24. The actuator output element 24 passes, with sealing, through an end wall 21*b* of the second piston chamber 21, which end wall is located opposite the end wall 21*a*, and (in the retracted state shown) projects slightly out of the second piston chamber 21. The two pistons 12 and 22 and the impact element 23 and the actuator output element 24 are oriented in alignment (coaxially) with respect to the movement axis A.

The second piston chamber 21 is connected via two lines 25*a* and 25*b* to second hydraulic means which comprise a hydraulic source, which is only symbolised by a line 26, a hydraulic accumulator 27, a second 4-port servo valve 28 configured for continuous operation, and a collecting tank 29. The two lines 25*a* and 25*b* open into the second piston chamber 21 in the region of the two longitudinal ends thereof. The operating pressure of the second hydraulic means is up to about 150 bar (low-pressure circuit). Instead of the second hydraulic means it would also be possible to provide pneumatic means, in which case analogously a pneumatic source would then be used instead of the hydraulic source and a gas accumulator instead of the hydraulic accumulator.

Connected to the first piston chamber 11 are two pressure sensors 31 and 32 which detect the pressures of a hydraulic medium located in the first piston chamber 11 on each side of the first piston 12. Likewise, two pressure sensors 33 and 34 are connected to the second piston chamber 21, which pressure sensors detect the pressures of a hydraulic or pneumatic medium located in the second piston chamber 21 on each side of the second piston 22.

The actuator device also has a position-measuring device 40 which detects the positions of the first piston 12 and the second piston 22 relative to a reference position that is fixed with respect to the device. The magnetically operating position-measuring device 40 comprises a sensor bar 41, position magnets 42 and 43 and an electronic measuring unit 44. The position magnets 42 are fixedly arranged in the first piston 12. The position magnets 43 are arranged in the free end of the impact element 23 and are fixedly joined thereto. Since the impact element 23 is in turn joined to the second piston 22 for conjoint movement therewith, the position of the second piston 22 is obtained directly from the position of the impact element 23. The fixed sensor bar 41 is arranged axially and projects through the first piston 12 into the free end of the impact element 23. In the event of a movement of the first or second piston 12, 22, respectively, the position magnets 42, 43, respectively, generate corresponding signals in the sensor bar 41 from which the electronic measuring unit 44 forms position or travel distance information.

The second piston 22 of the second drive unit 20 can be moved along the movement axis A in the direction of arrow P1 (outward direction) as a result of being acted upon by pressurised hydraulic medium via the line 25*a* and in the direction of arrow P2 (inward direction) as a result of being acted upon by pressurised hydraulic medium via the line 25*b*. The impact element 23 is accordingly moved therewith and the actuator output element 24 is moved respectively out of and back into second piston chamber 21.

The first piston 12 of the first drive unit 10 can be moved along the movement axis A in the direction of arrow P1 (outward direction) as a result of being acted upon by pressurised hydraulic medium via the line 15*a*. The return movement of the first piston 12 in the direction of arrow P2 (inward direction) is effected as a result of the first piston 12 being acted upon by hydraulic medium from the hydraulic accumulator 17*b* via the line 15*b*. The second piston 22 is coupled to the first piston 12 via the impact element 23 solely for thrust. That is to say, the first piston 12 is able to carry along the second piston 22 and therewith the actuator output element 24 in the outward direction only during its movement in the outward direction. The coupling of the two pistons 12 and 22 for thrust is of course active only when the two pistons are located in those positions in which the impact element 23 is in contact with the first piston 12, as shown in FIG. 1. As a result of the described coupling of the two drive units 10 and 20, or the pistons 12 and 22 thereof, the actuator output element 24 can (depending upon the position of the two pistons) be moved in the direction of arrow P1, that is to say moved outwards, by both drive units 10 and 20. More details in this connection are given hereinbelow with reference to typical examples of use.

The movement or travel of the first piston 12 and the second piston 22 along the movement axis A can be pressure- or force-controlled by corresponding regulation of the servo valves 18 and 28 with the aid of the pressure sensors 31-34 (pressure and force are proportional over the effective piston surface areas) and position-controlled with the aid of the position-measuring device 40. As shown in block diagram form in FIG. 2, the actuator device has for that purpose a control device 50 which co-operates with the position-measuring device 40 and the pressure sensors 31-34 and, by appropriate actuation of the two servo valves 18 and 28, is configured to effect position- and force-controlled movement of the first piston 12 and the second piston 22 and therewith the actuator output element 24. The control device 50 also comprises an operator interface 51, via which it is possible to set the required forces and pressures and piston positions or piston stroke lengths during practical use of the actuator device. Instead of or in addition to the pressure sensors 31-34, a force sensor can also be mounted on the actuator output element 24, the force signal of which can be used for controlling the movement of the pistons.

The two drive units 10 and 20 have different layouts. The first piston 12 of the first drive unit 10 has an effective piston surface area that is substantially greater than that of the second piston 22 and is also acted upon by higher operating pressure. As a result, the first drive unit 10 can generate substantially greater thrust/holding forces or braking forces than the second drive unit 20. Conversely, however, the movement of the first piston requires a substantially greater volume flow rate and is therefore slower. The second piston 22 of the second drive unit 20 has a relatively small effective piston (annular) surface area. As a result, the second drive unit 20 is able to generate only relatively small thrust/holding forces or braking forces. On the other hand, however, the second piston 22 can be accelerated and moved relatively quickly with a small volume flow rate. The combination of the two drive units 10 and 20 allows a certain degree of separation of force and movement. It enables very large thrust forces to be generated at relatively low speed and for smaller thrust forces to be generated via a relatively large piston stroke length at relatively high speed. The combination of the two drive units 10 and 20 provides optimum flexibility in respect of the use conditions or the usability of the actuator device.

In practice the first and second piston chambers 11 and 21 are preferably hollow-cylindrical and the first and second pistons 12, 22, respectively, are correspondingly cylindrical. The internal diameter of the first piston chamber 11 is, for example, about 80 mm, that of the second piston chamber 21 about 50 mm. The diameter of the impact element 23 and the diameter of the actuator output element 24 are in each case about 40 mm. With those dimensions the effective piston surface area of the first piston 12 is $\Pi*40^2 mm^2$ on each side and the effective piston (annular) surface area of the second piston 22 is $\Pi*(25^2-20^2)\ mm^2$ on each side.

The actuator device according to the invention is suitable for applications in which an object needs to be acted upon with a directed force. The application of force can be used, for example, to effect controlled movement of the object over a certain distance along a movement axis and in so doing overcome a resistance opposing the movement of the object (thrust force). An example thereof is the ejection of a shaped workpiece from a forming die of a forming device. The application of force can also be used to support or hold an object in place during the action of an opposing external force (holding force). An example thereof is the support of a blank to be shaped in a forming die while the blank is being acted upon by a punch. Furthermore, the actuator device is suitable for effecting controlled braking of the movement of the object brought about by the opposing action of an external force (braking force). An example thereof is the introduction, with controlled braking, of a blank into the forming die of a forming device. Movement, support and braking of an object can also be combined by means of the actuator device according to the invention and implemented in any desired order. The actuator device according to the invention is very especially suitable for use in forming devices for moving, supporting and braking shaped parts.

The basic functions of the actuator device (movement, support, braking), which will be apparent from the following description of typical applications, are individually adjustable and adaptable to the application in question. The fundamental advantages of the actuator device according to the invention are low wear to mechanical components; smooth movement sequence when used in a high-speed forming process; safe, central application of force; scope for very flexible realisation of the positions in the process; and a high degree of safety as a result of overload protection of the hydraulic system.

FIG. 3 shows the actuator device in a practical application, the actuator device being flange-mounted as a unit on a machine body 110 of a forming device 100. In the drawing the first and second hydraulic means are here combined in a hydraulic block 60, with only the hydraulic accumulator 17*b*, the two servo valves 18 and 28 and the two lines 25*a* and 25*b* being indicated separately.

The machine body 110 of the forming device has a through-opening 111 into which the actuator output element 24 of the actuator device projects. On the side of the machine body 110 opposite the actuator device there is mounted a forming die 120 which likewise has a through-opening 121 and in which deformable material (shaped workpiece) W is located. Between the deformable material W and the actuator output element 24 there is located an ejector ram 122. On movement of the second piston 22 in the direction towards the machine body 110, the actuator output element 24, via the ejector ram 122, ejects the deformable material or the shaped workpiece W out of the die 120.

FIGS. 4-9 show the actuator device in various operating phases when used as an ejecting device for a deformable material that has been shaped in a forming device. As shown in FIG. 3, the actuator output element 24 drives an ejector ram 122 which in turn ejects the deformable material W out of a forming die 120. The forming device with the forming die and the deformable material and also the ejector ram are not shown in FIGS. 4-9.

For the ejection of a deformable material that has been shaped in a die, first of all a relatively large release force is required in order to break the deformable material away from the die, the deformable material being moved only a negligible amount in the die at relatively low speed. For the subsequent actual ejecting movement, then only a considerably smaller ejection force is required, but the deformable material (depending upon its dimensions) is displaced over a relatively large travel distance out of the die until it passes over the front edge thereof. In the interests of a high machine cycle rate, i.e. a short machine cycle, of the forming device, the ejection of the deformable material must be effected with the highest possible acceleration and speed.

Figure 4:
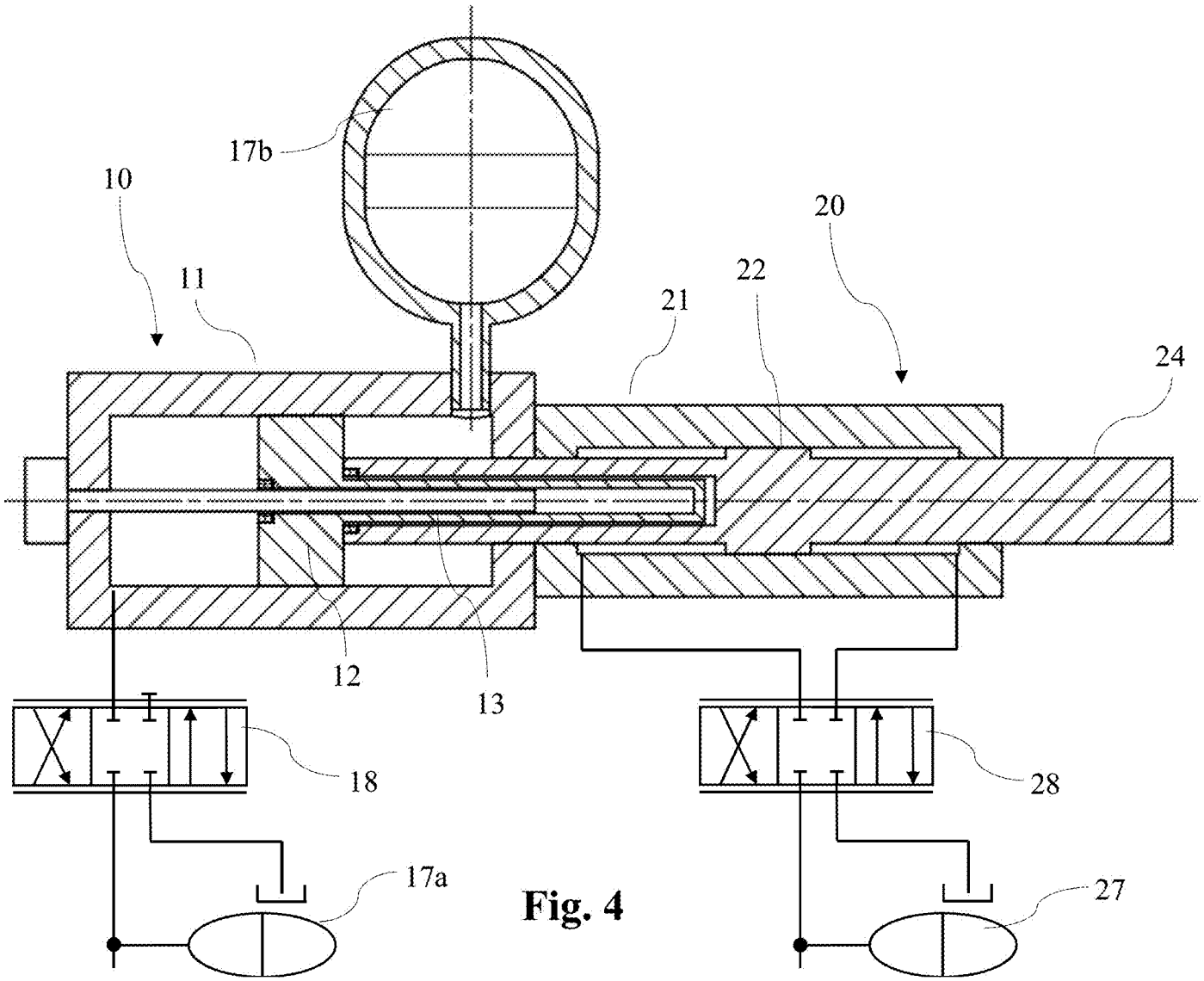
FIGS. 4-9—show the actuator device of FIG. 1 in various phases in a first application, and an associated force-path-time diagram.

FIG. 4 shows the actuator device in the starting position, wherein the two pistons 12 and 22 and therewith the actuator output element 24 have traveled into a predetermined position which depends upon the height of the deformable material (in the ejection direction) and the position thereof in the die (distance from the front edge of the die). The configuration corresponds to that of FIG. 3.

Figure 5:
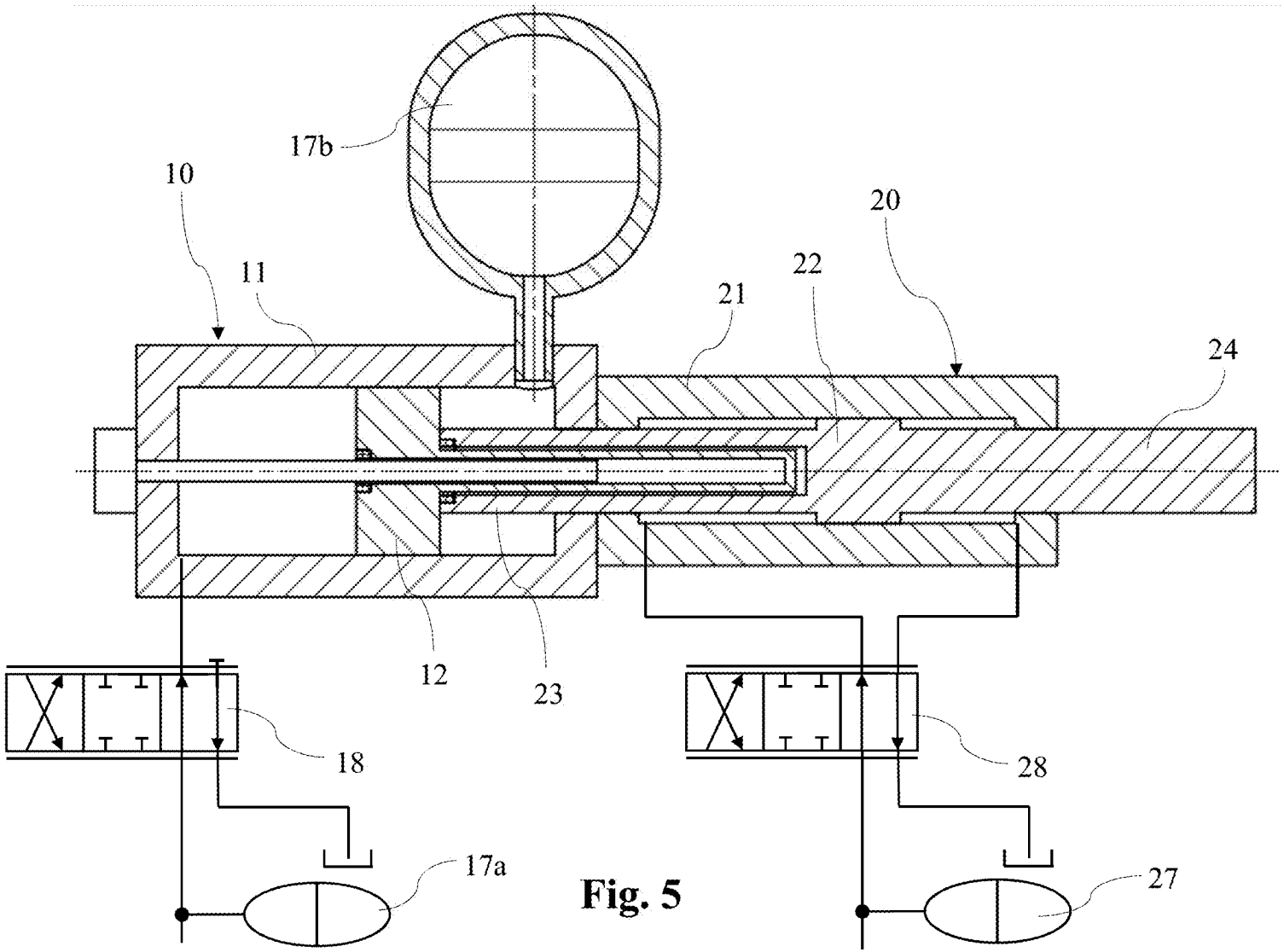

FIG. 5 shows the actuator device in a release phase. Both pistons 12 and 22 are moved outwards in a position-controlled manner, the release force being applied by the first drive unit 10 or the piston 12 thereof. The impact element 23 is still in contact with the first piston 12. During the outward movement of the first piston 12, the hydraulic medium in front of the first piston 12 is pushed into the hydraulic accumulator 17*b*. The release of the deformable material from the die is effected in a position-controlled manner with limitation of the maximum pressure or maximum force.

Figure 6:
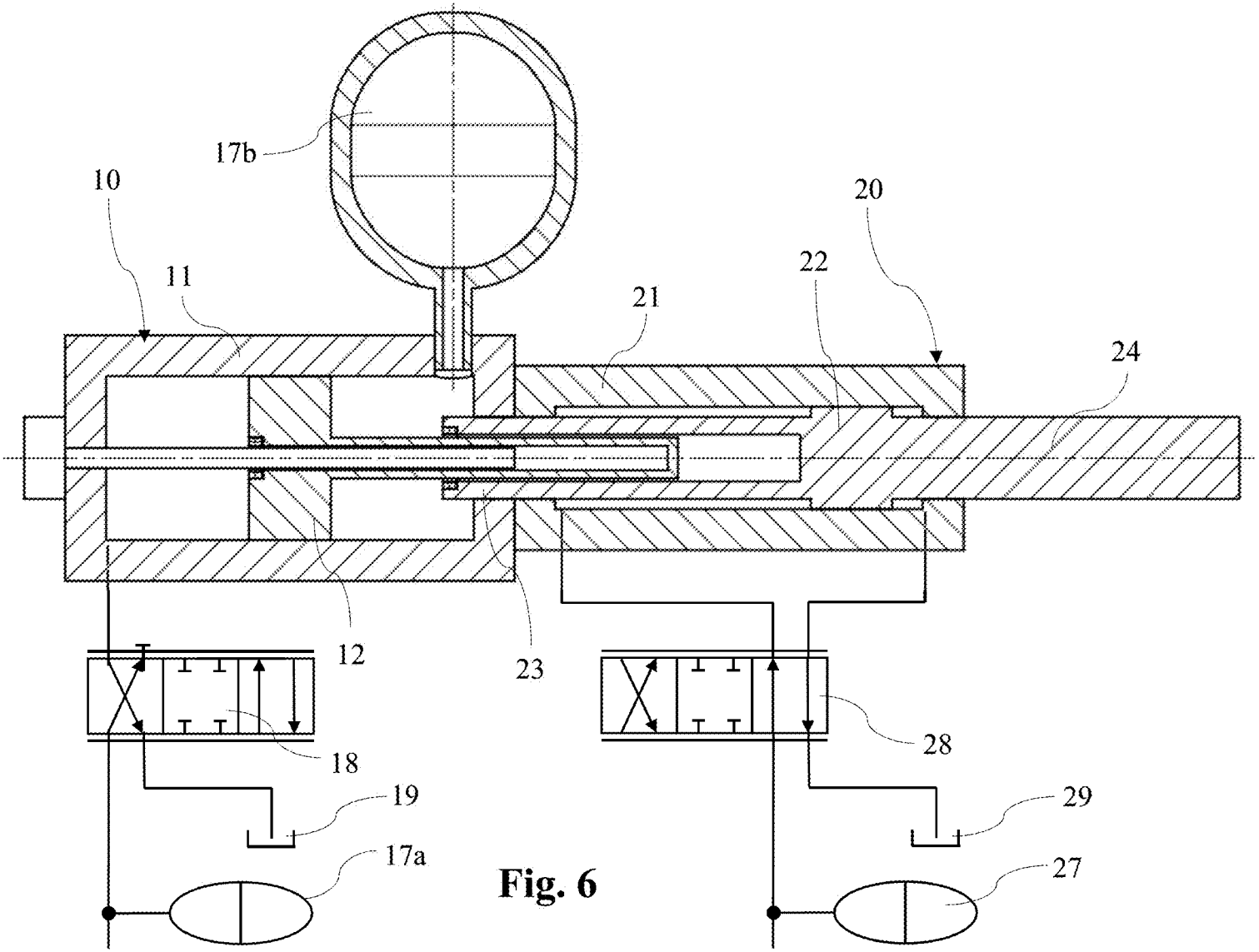

FIG. 6 shows the actuator device in a thrusting phase. Once the deformable material has been released from the die, which can be recognised by a drop in pressure or by a force signal if a corresponding force sensor is mounted on the actuator output element 24, the second piston 22 moves outwards in a position-controlled manner, the actuator output element 24 ejecting the deformable material from the forming die (moving it into a position in front of the front edge of the die). That is the actual ejecting movement, which can be carried out very quickly by means of the second drive unit 20. The first piston 12 is in the meantime returned to its starting position in a position-controlled manner by the pressure of the hydraulic accumulator 17*b*. The servo valve 18 opens in a controlled manner to the collecting tank 19. Alternatively the first piston 21 can also be reset during the subsequent return movement (inward direction) of the second piston 22 by the latter via the impact element 23.

Figure 7:
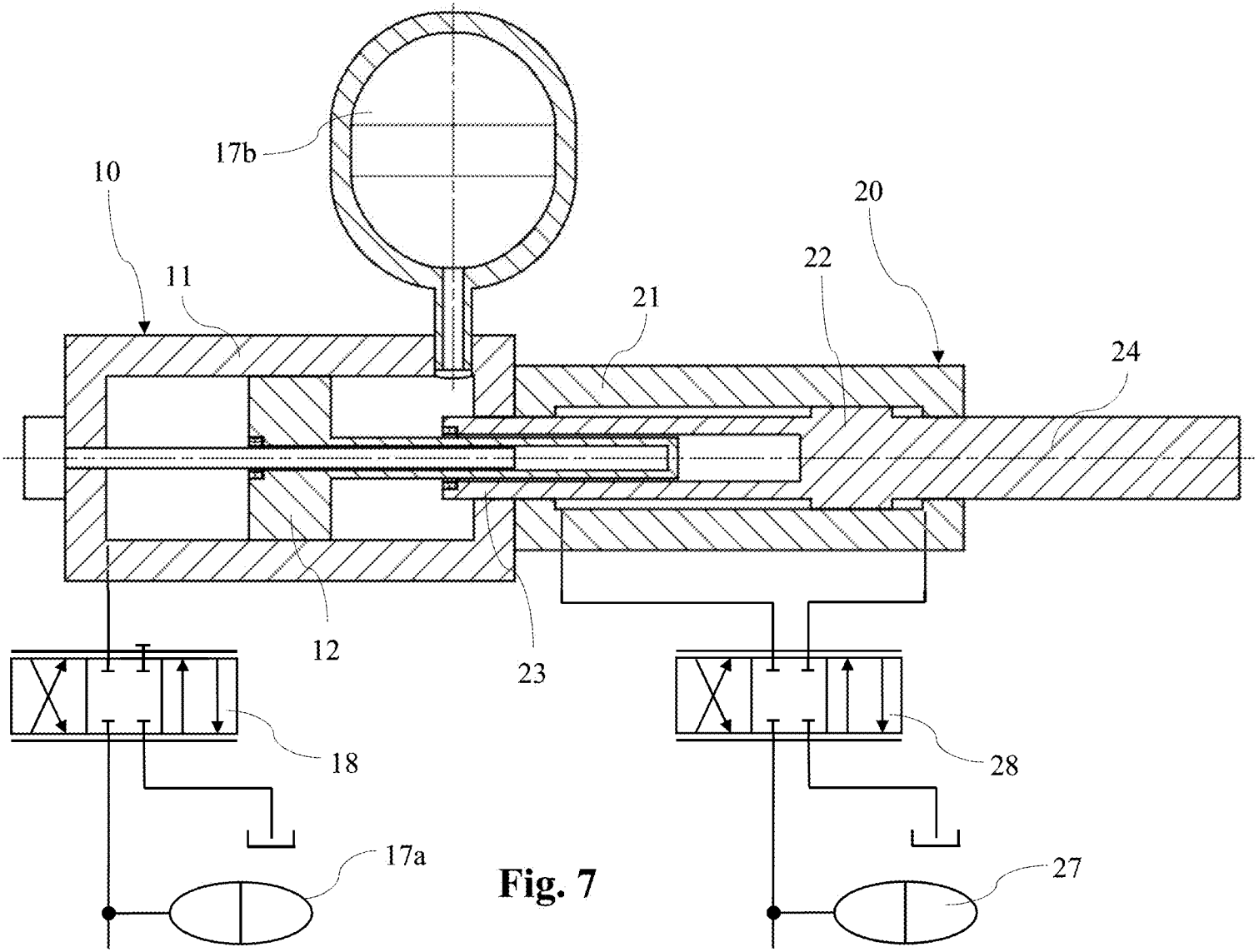
Figure 8:
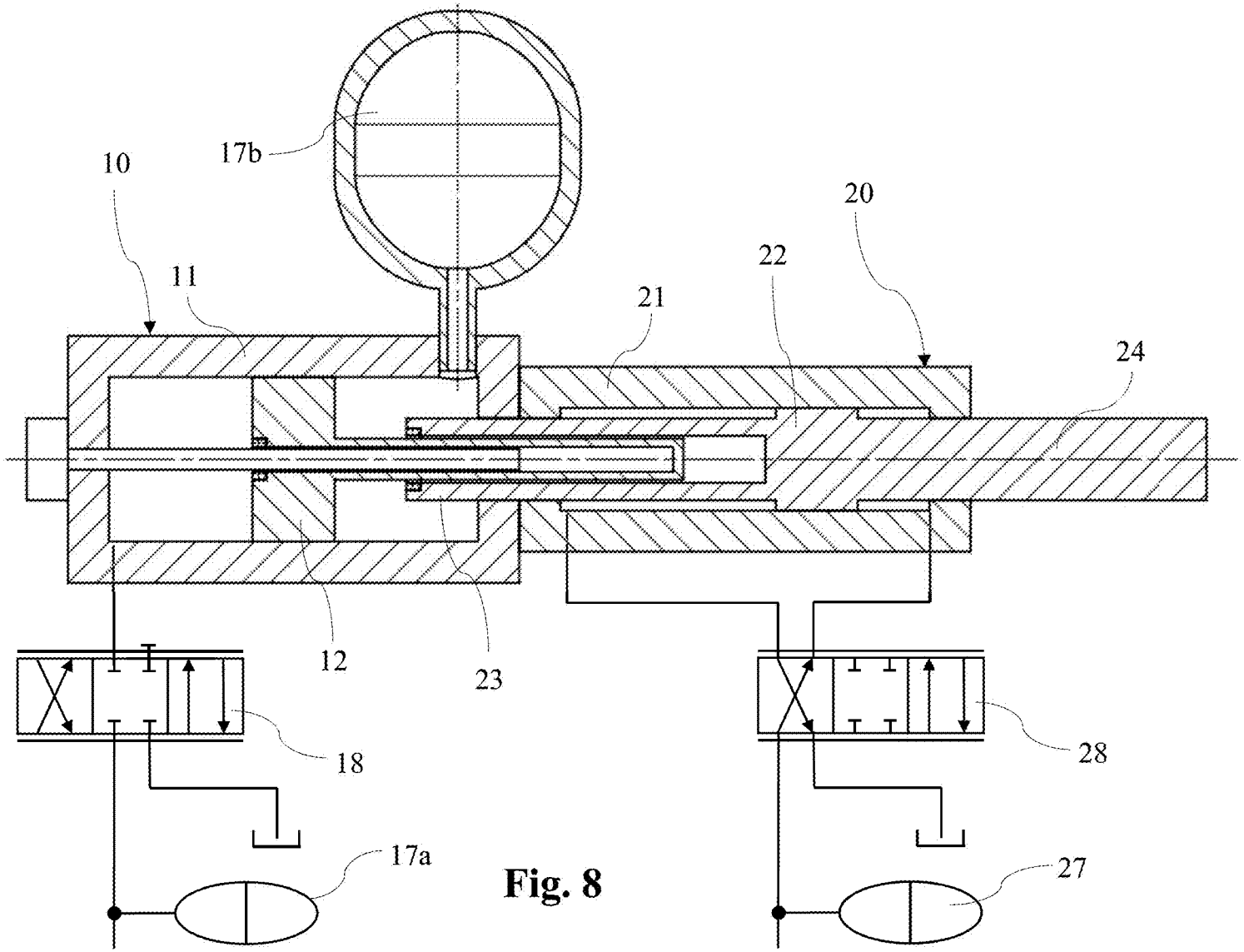

FIG. 7 shows the actuator device in a holding phase. The first piston 12 is located in its starting position, the second piston 22 and the actuator output element 24 have moved outwards to an extent such that the deformable material is located in front of the front edge of the forming die, from where it can be transported away by the transport system of the forming device.

In the next machine cycle of the forming device, fresh deformable material (blank to be shaped) is positioned in front of the forming die and introduced into the forming die, for example, by means of an appropriately force-actuated punch. As a result, the actuator output element 24 is pushed in the inward direction P2 by the blank (via the ejector ram). The actuator device is then located in a braking phase shown in FIG. 8 in which the control of the movement of the second piston 22 changes from position-control to force-control with position-monitoring and the introduction movement of the blank is opposed by, that is to say braked by, a controlled braking force. During the introduction of the blank the second piston 22 is moved inwards in a force-controlled manner, with position-monitoring, until it reaches its starting position according to FIG. 4. The braking force is relatively small and is in any case set to be small enough not to bring about any deformation of the blank.

The blank is then formed into the desired shape in the forming die by the punch of the forming device.

Figure 9:
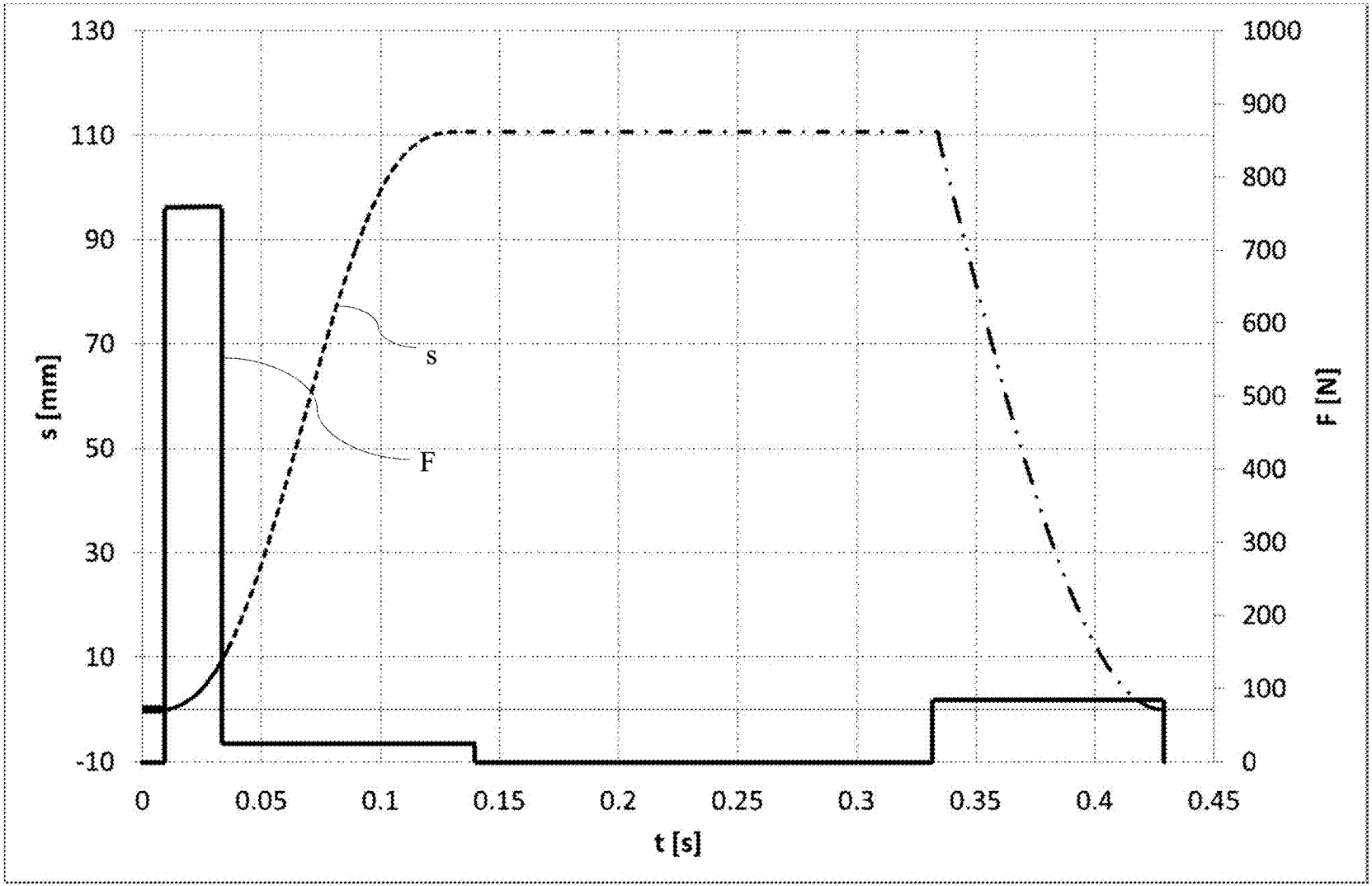
Figure 12:
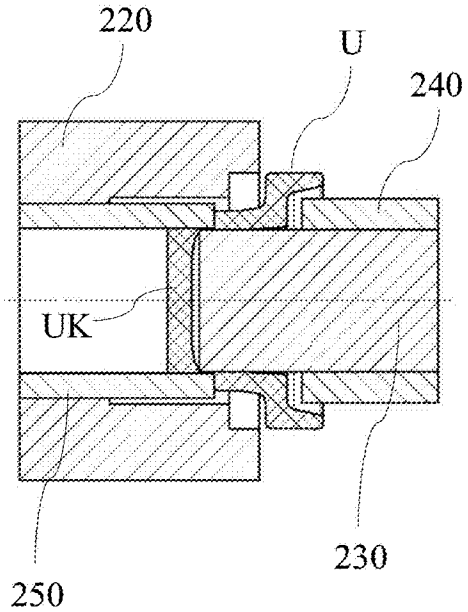
FIGS. 10-17—show in diagrammatic form the process sequence of a second application during the piercing/separating of a shaped part in a forming device.

FIG. 9 shows the thrust force that arises during an ejection cycle of the actuator device and that is to be applied by the device via the actuator output element 24 thereof and also the travel path (stroke length from the starting position) of the actuator output element 24 as a function of the cycle time t. The dashed line shows the travel path s, the solid line shows the force F. During the release phase (FIG. 5) the actuator output element 24 moves only a relatively short distance. The release force to be applied is (briefly) relatively high. In the subsequent thrusting phase (FIG. 6) the actuator output element 24 is greatly accelerated with application of a relatively small force and is rapidly moved outwards to its full extent. A brief stationary period is followed by the holding phase (FIG. 7) and then the braking phase (FIG. 8), the actuator output element 24 being moved inwards into its starting position according to FIG. 4 again in a force-controlled manner with a constant braking force.

FIGS. 10-17 show a typical process sequence during piercing and separation of a shaped part in a forming device.

Of the forming device only a separating die 220, a stamping punch 230, a separating sleeve 240 and a spacer sleeve 250 are shown. A blank to be pierced and separated (deformable material) is denoted by U. Analogously to FIG. 3 the spacer sleeve 250 is joined to the actuator output element 24 of the actuator device via an impact element (not shown) and is force-actuated by the latter during operation. FIGS. 18-21 show the corresponding positions of the actuator output element 24 and the two pistons 12 and 22 during the individual steps of the process sequence.

The forces described below as "strong force" and "weak force" are to be understood as being the thrust, holding and braking forces applied by the first drive unit 10 and the second drive unit 20.

Figure 10:
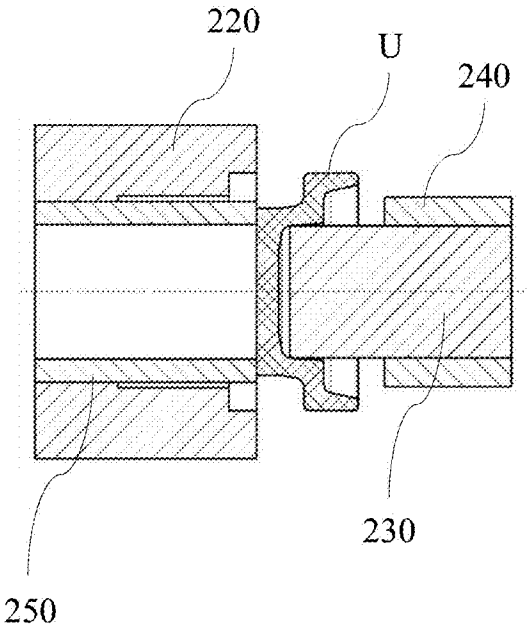
Figure 18:
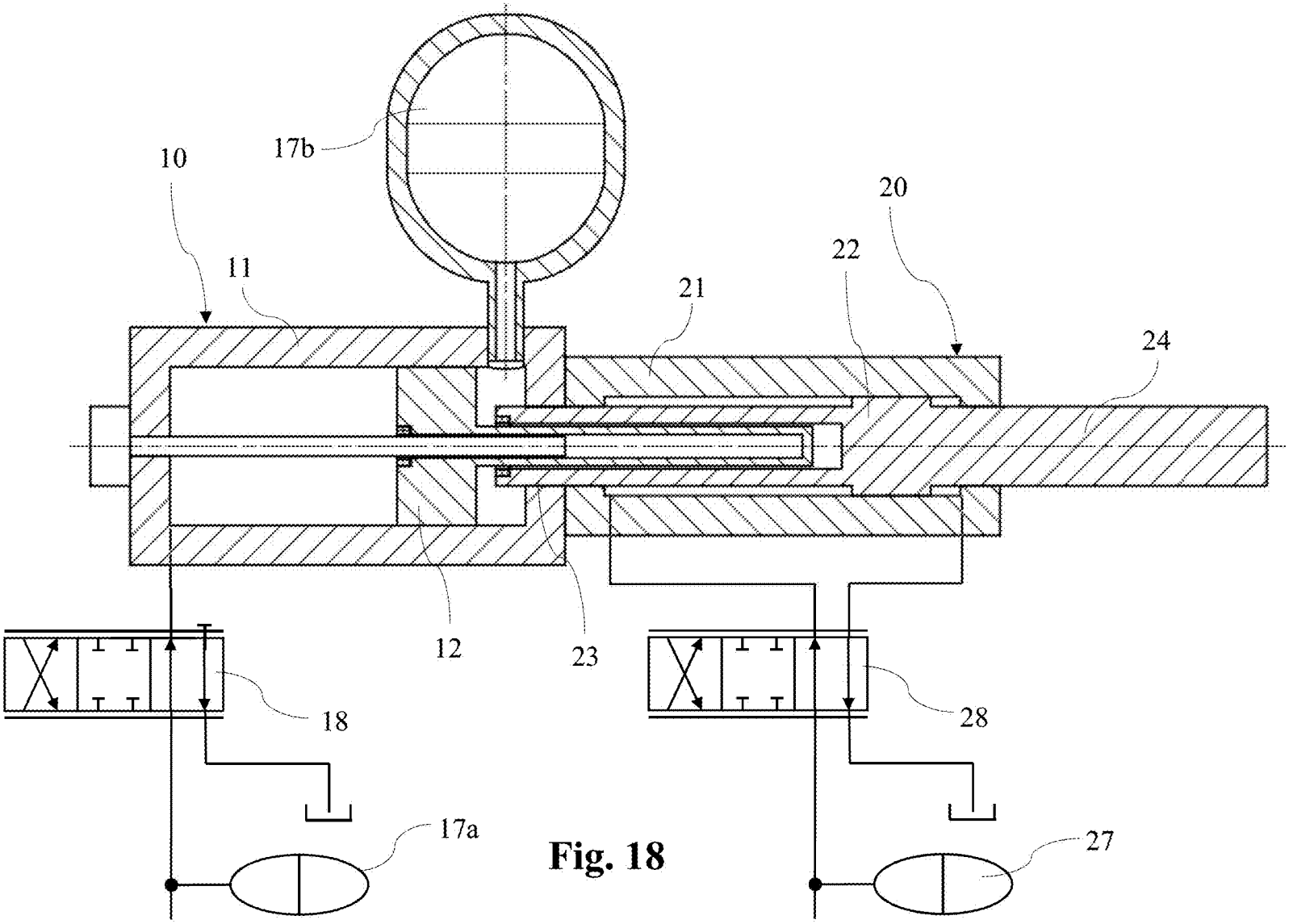
FIGS. 18-22—show the actuator device of FIG. 1 in various phases in the second application during the piercing/separating of a shaped part, and an associated force-path-time diagram.
Figure 19:
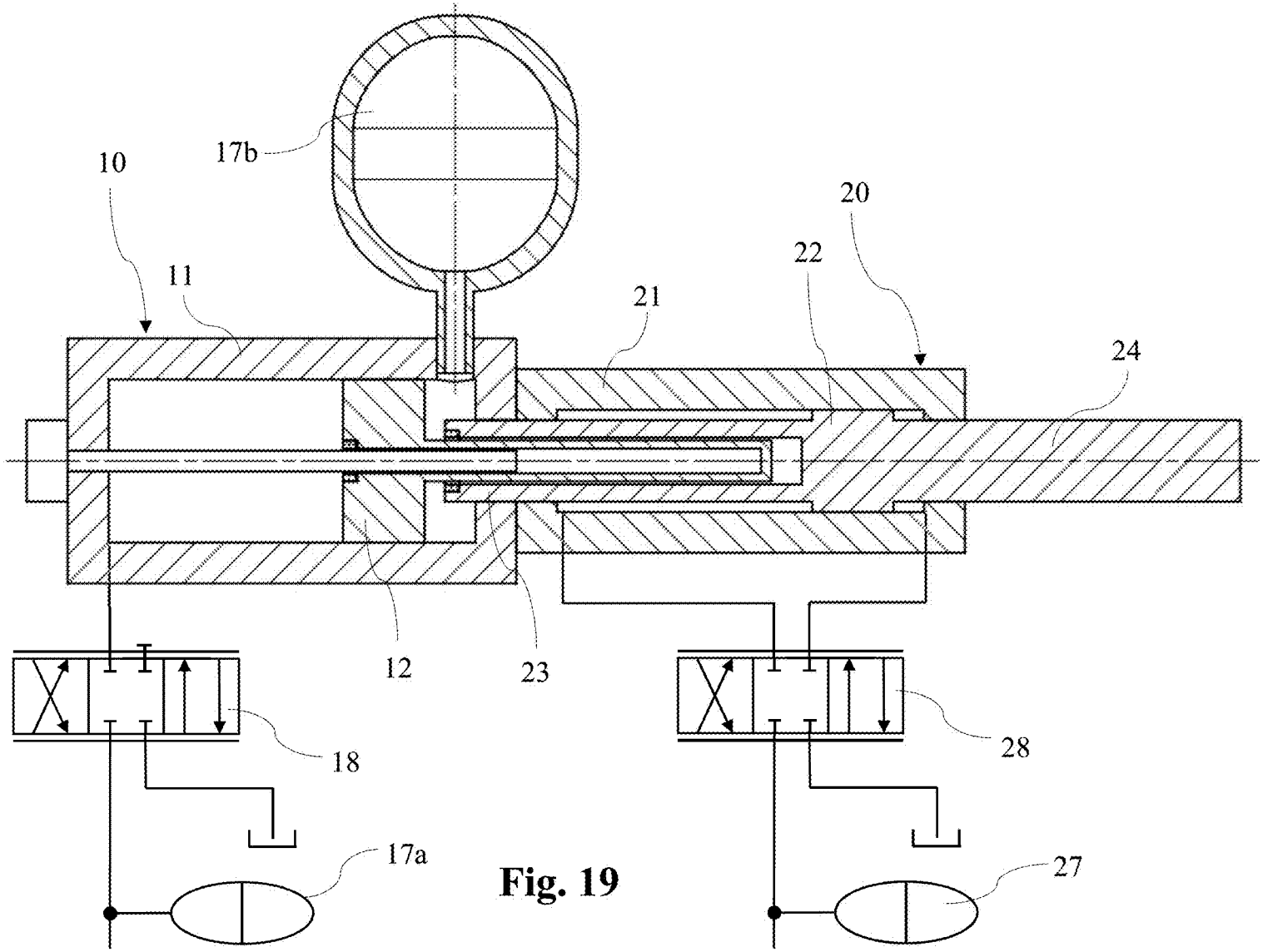
Figure 20:
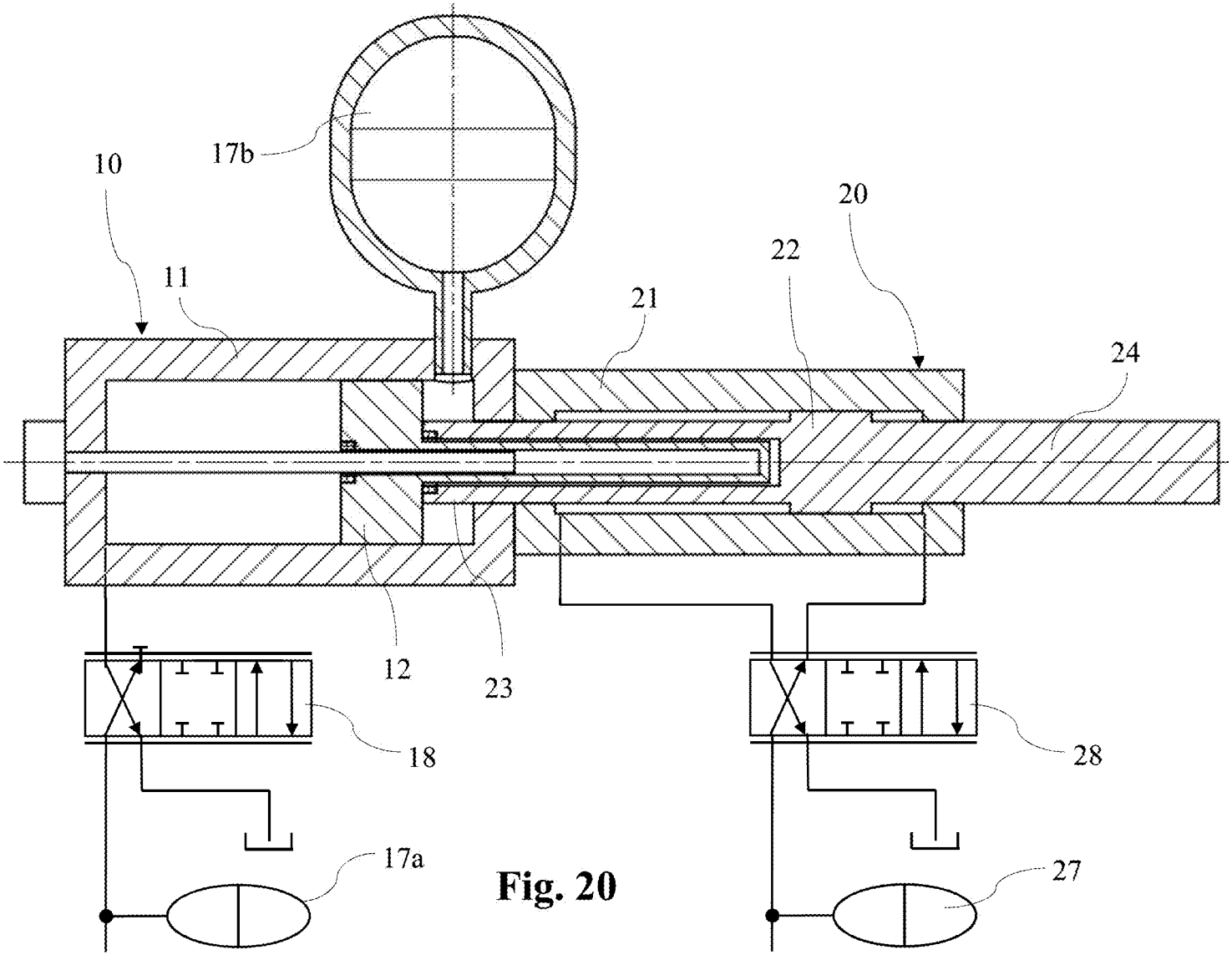
Figure 21:
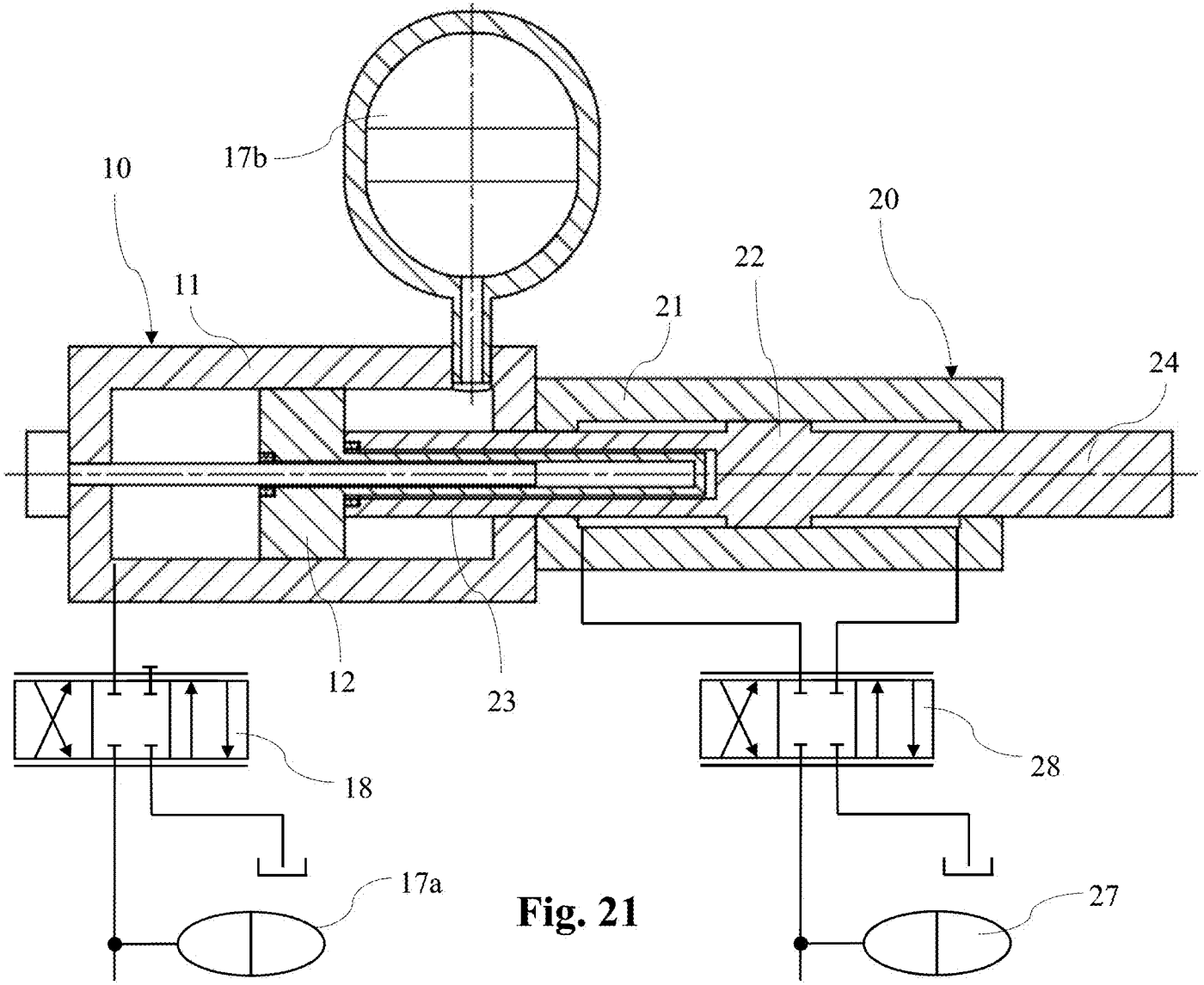

At the beginning of the piercing and separating process the two pistons 12 and 22, starting from a starting position (FIG. 21), move outwards in a position-controlled manner into the position shown in FIG. 18 (thrusting phase) and FIG. 19 (holding phase). The spacer sleeve 250, which is driven or force-actuated by the actuator output element 24, is located just in front of the front edge of the separating die 220. The deformable material U has been positioned in front of the separating die 220 by a transport device of the forming device (FIG. 10).

Figure 11:
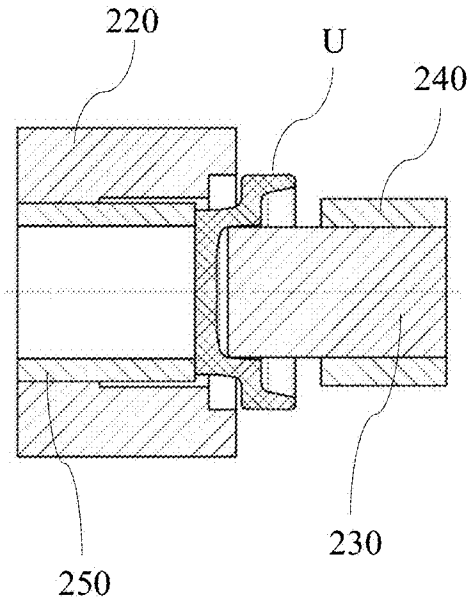

In the next step the stamping punch 230 and the separating sleeve 240 move towards the separating die 220 and press the deformable material U a short way into the latter (FIG. 11). This movement is braked by the actuator device with a small force, the second piston 22 being moved inwards until it assumes the position shown in FIG. 20.

In the next step (FIG. 12), the stamping punch 230 thrusts a core portion UK of the deformable material U into the spacer sleeve 250, the actuator device supporting the spacer sleeve 250 with a large force.

Figure 14:
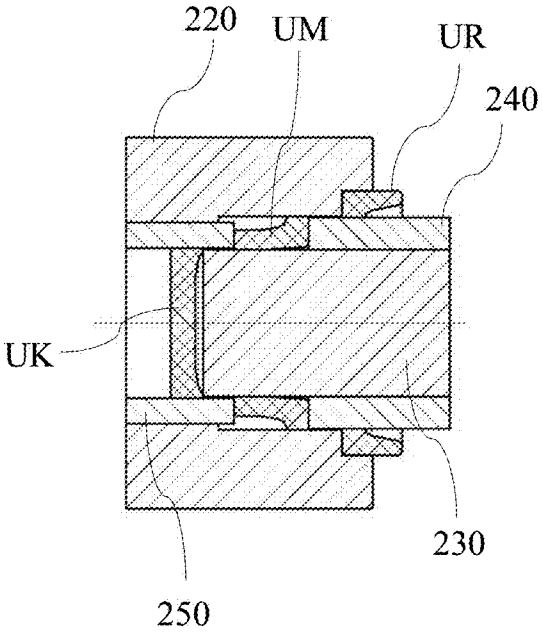
Figure 13:
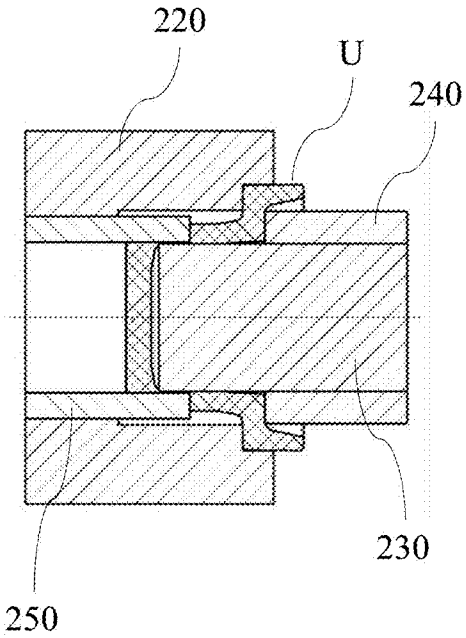

In the next step (FIG. 13), the separating operation begins. The separating sleeve 240 moves towards the separating die 220 and thrusts the deformable material U into the forming die. At the same time the two pistons 12 and 22 of the actuator device return to their starting positions (FIG. 21) in a position- and force-controlled manner and during this inward movement brake the displacement of the spacer sleeve 250 with a small force. In this step the portion of the deformable material that remains after the stamping-out of the core portion UK is divided into an annular centre portion UM and an annular rim portion UR, as shown in FIG. 14.

Figure 15:
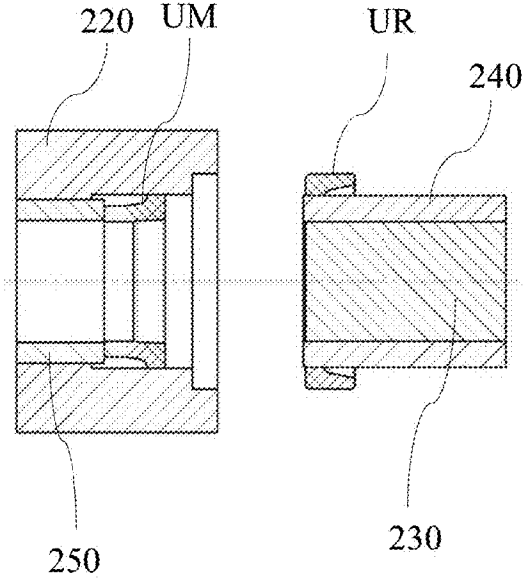

Then the stamping punch 230 and the separating sleeve 240 move back again (FIG. 15).

Figure 17:
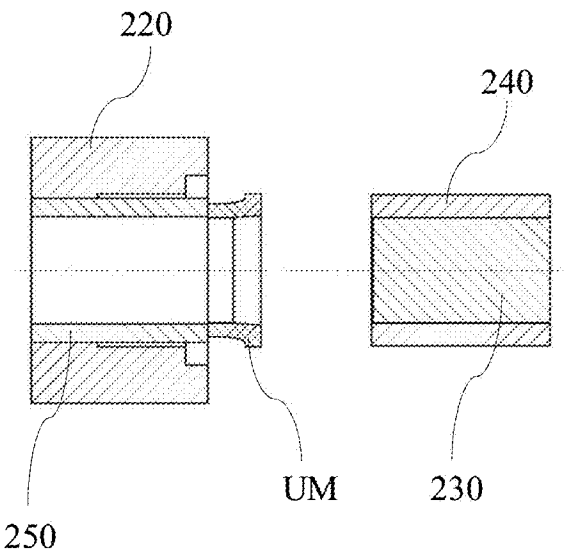
Figure 16:
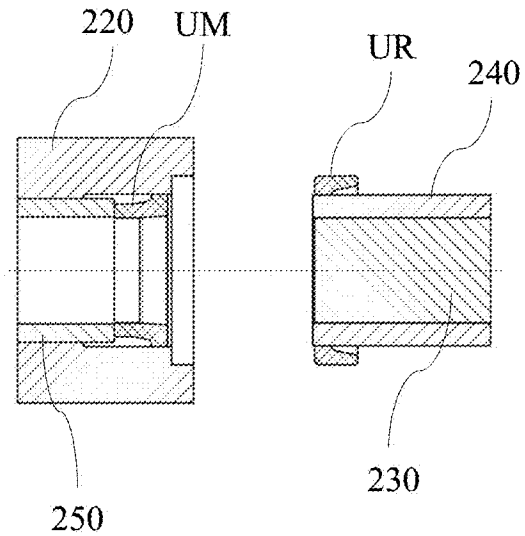

Simultaneously or subsequently the actuator output element 24 moves outwards again in a position-controlled manner (FIG. 18) and begins the operation of ejecting the centre portion UM (FIG. 16). Once the actuator output element has reached the holding position shown in FIG. 19, the centre portion UM is located in front of the separating die 220, where it can be transported away by the transport device of the forming device (FIG. 17). A new piercing and separating cycle can then begin.

Figure 22:
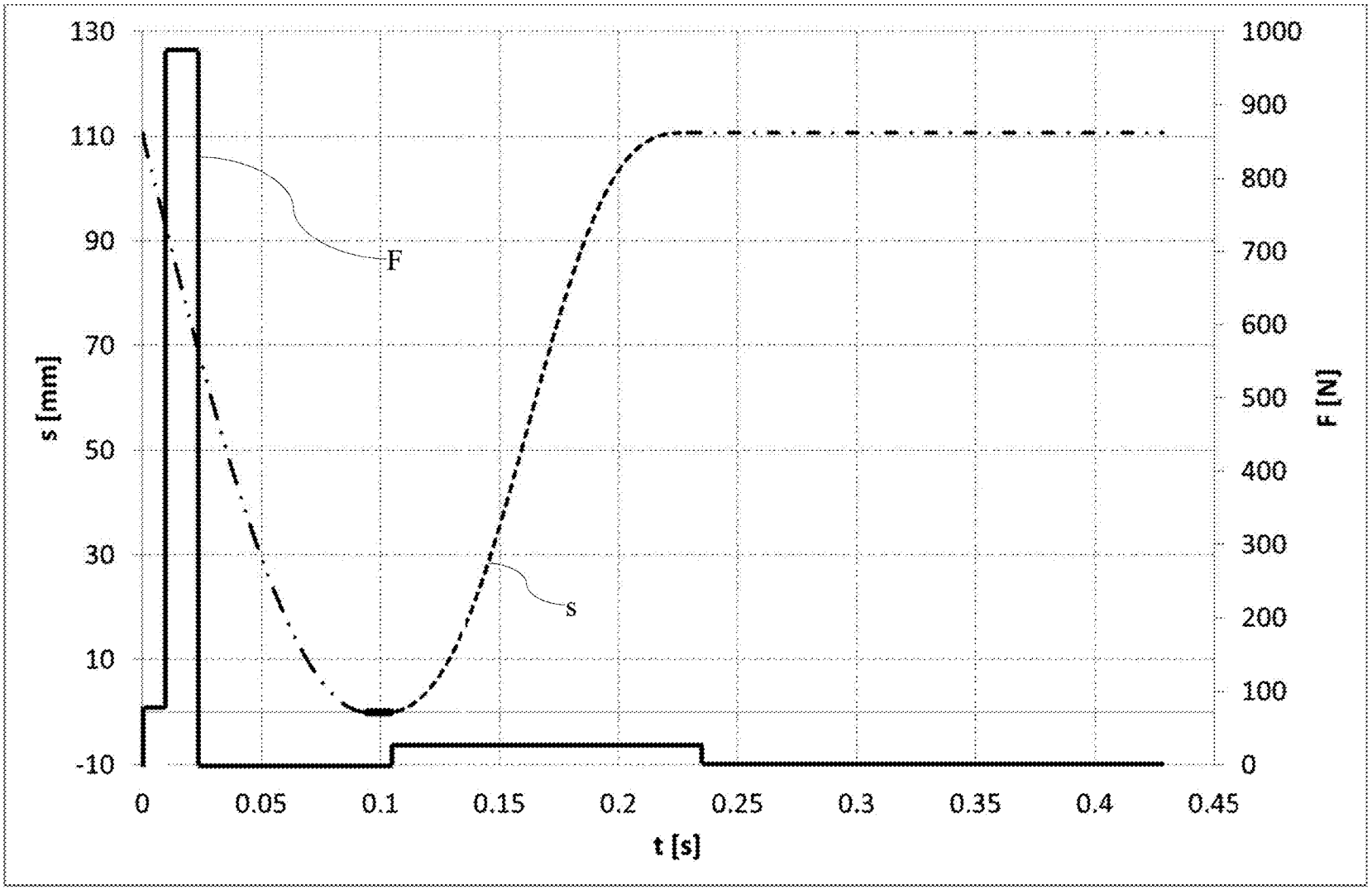
Figure 27:
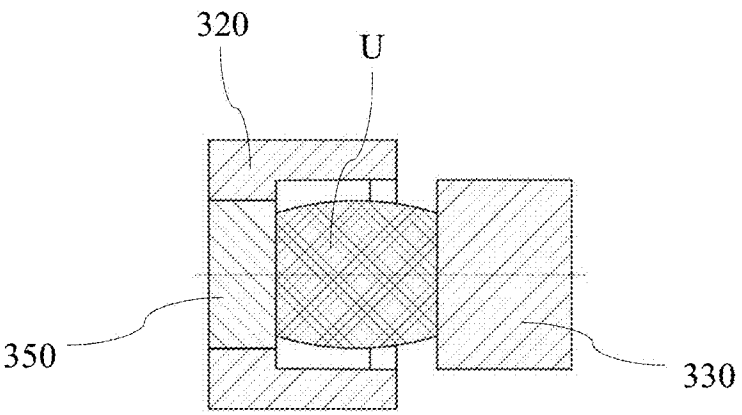
Figure 26:
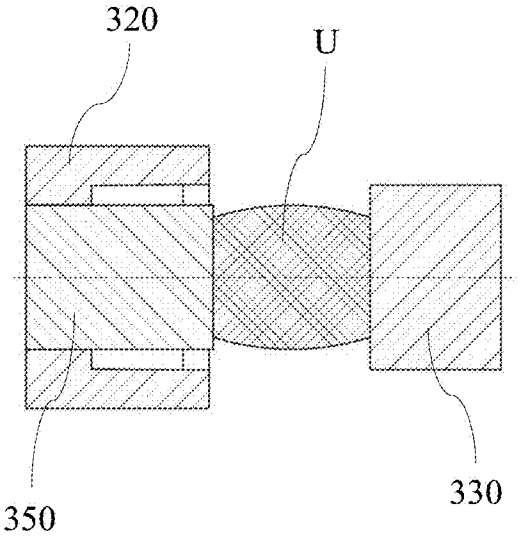

FIG. 22 shows the thrust force that arises during a piercing and separating cycle of the actuator device and that is to be applied by the device via the actuator output element 24 thereof and also the travel path (stroke length from the starting position) of the actuator output element 24 as a function of the cycle time t. The dashed line shows the travel path s, the solid line shows the force F.

FIGS. 23-28 show a typical process sequence for descaling and shaping a shaped part in a forming device.

Of the forming device only a forming die 320, a punch 330 and an ejector ram 350 are shown. A blank (deformable material) to be descaled and shaped is denoted by U. Analogously to FIG. 3 the ejector ram 320 is joined to the actuator output element 24 of the actuator device directly or via an impact element (not shown) and is force-actuated by the latter during operation. FIGS. 29-33 show the corresponding positions of the actuator output element 24 and the two pistons 12 and 22 during the individual steps of the process sequence.

The process cycle is shown starting from deformable material U that has already been shaped in the forming die 320 (FIG. 23). The punch 330 has already returned. The actuator output element 24 and the pistons 12 and 22 are located in the starting position shown in FIG. 29, the ejector ram 350 assuming the position shown in FIG. 23.

Figure 30:
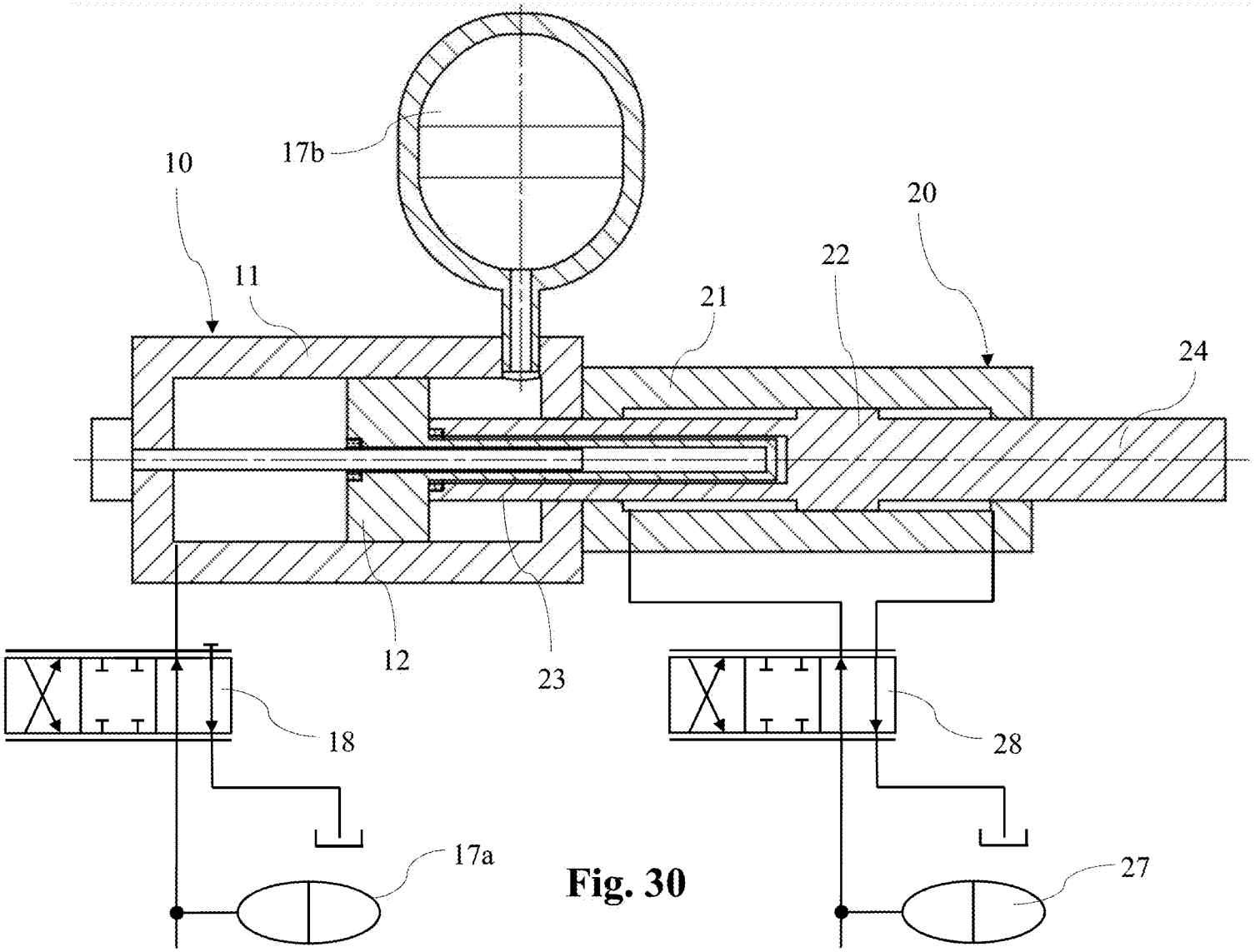
Figure 31:
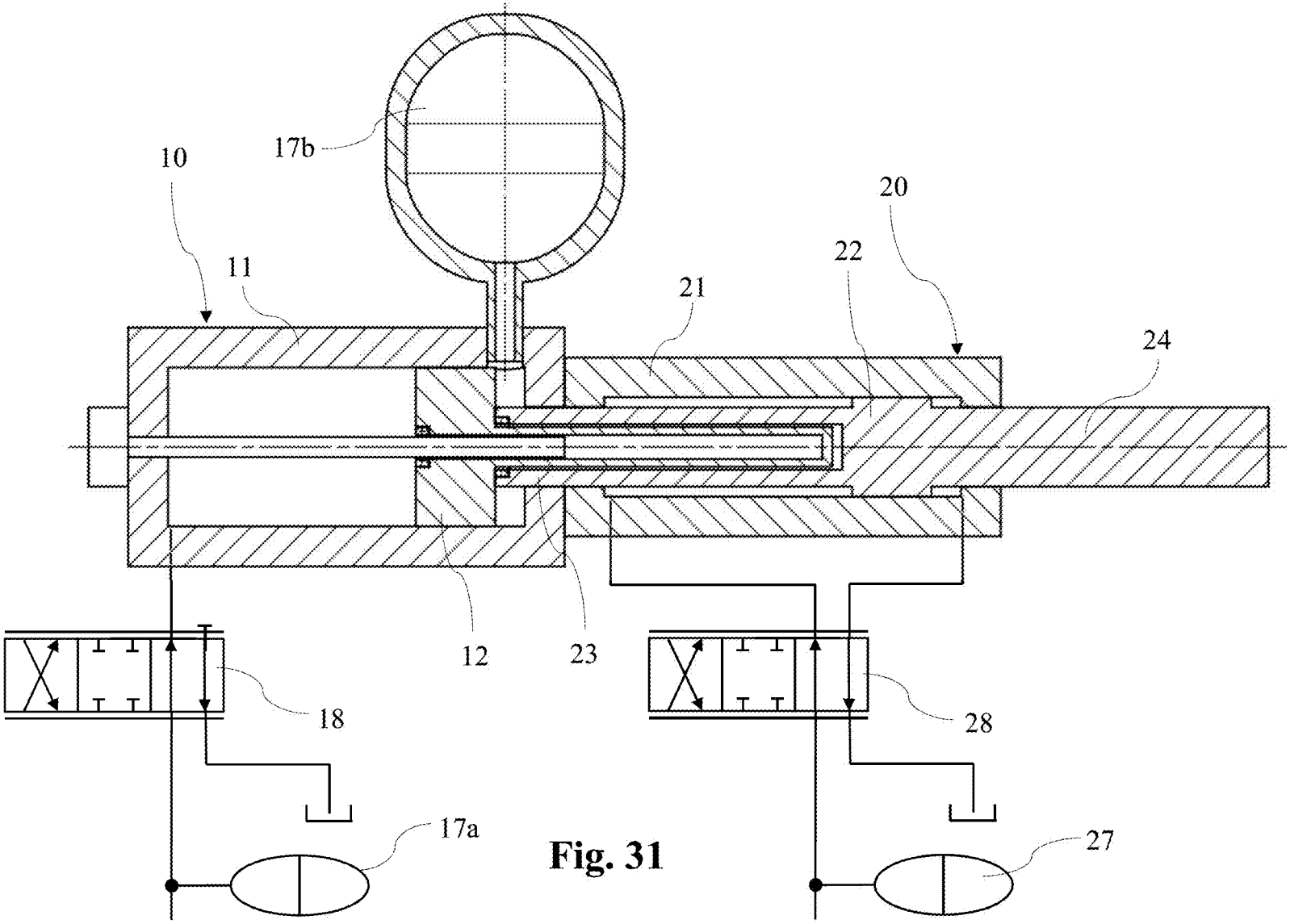
Figure 32:
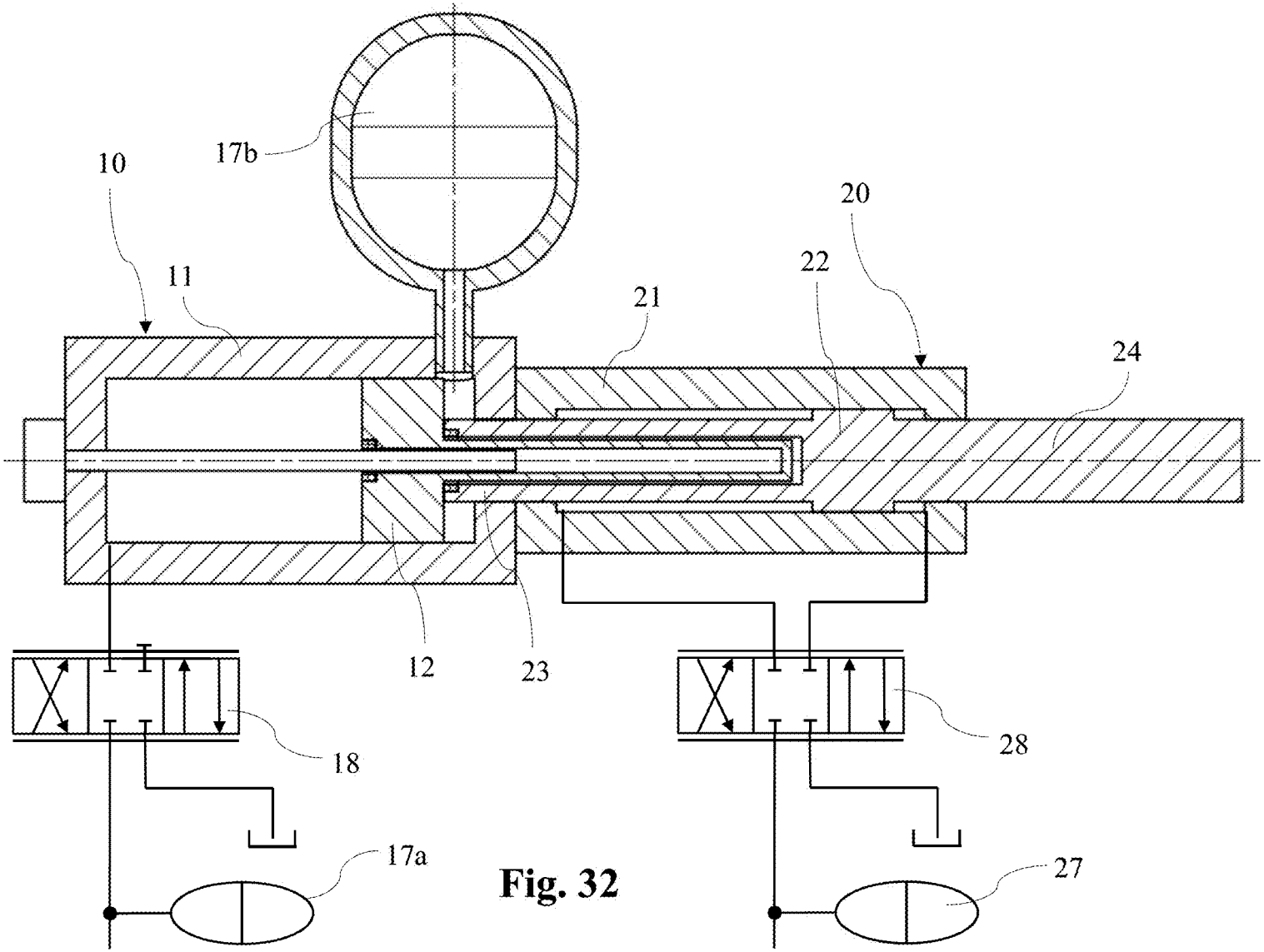

Next the release and ejection of the deformable material U from the forming die 320 takes place. FIG. 30 shows the actuator device in the release phase. FIG. 31 shows the actuator device in the ejection phase and FIG. 32 shows the positions of the two pistons 12 and 22, which have moved outwards together, in the fully extended state (holding phase), the deformable material then being located in front of the forming die 320 (FIG. 24) and can be transported away. The release and ejection of the deformable material is effected in the same way as described in connection with FIGS. 4-8. The release is effected with a large force, the further ejection with a small force.

In the next step, the finished shaped deformable material is transported away and a new blank U to be shaped is positioned in front of the forming die 320 by the transport device of the forming device (FIG. 25). The actuator output element 24 is still in the holding position according to FIG. 32.

Before the actual forming operation, the blank U is descaled. For that purpose the blank is compressed slightly by means of the punch 330, the required large counter-force (holding force) being applied by the actuator device, or the actuator output element 24 thereof, which is located in the holding position (FIG. 32).

Figure 29:
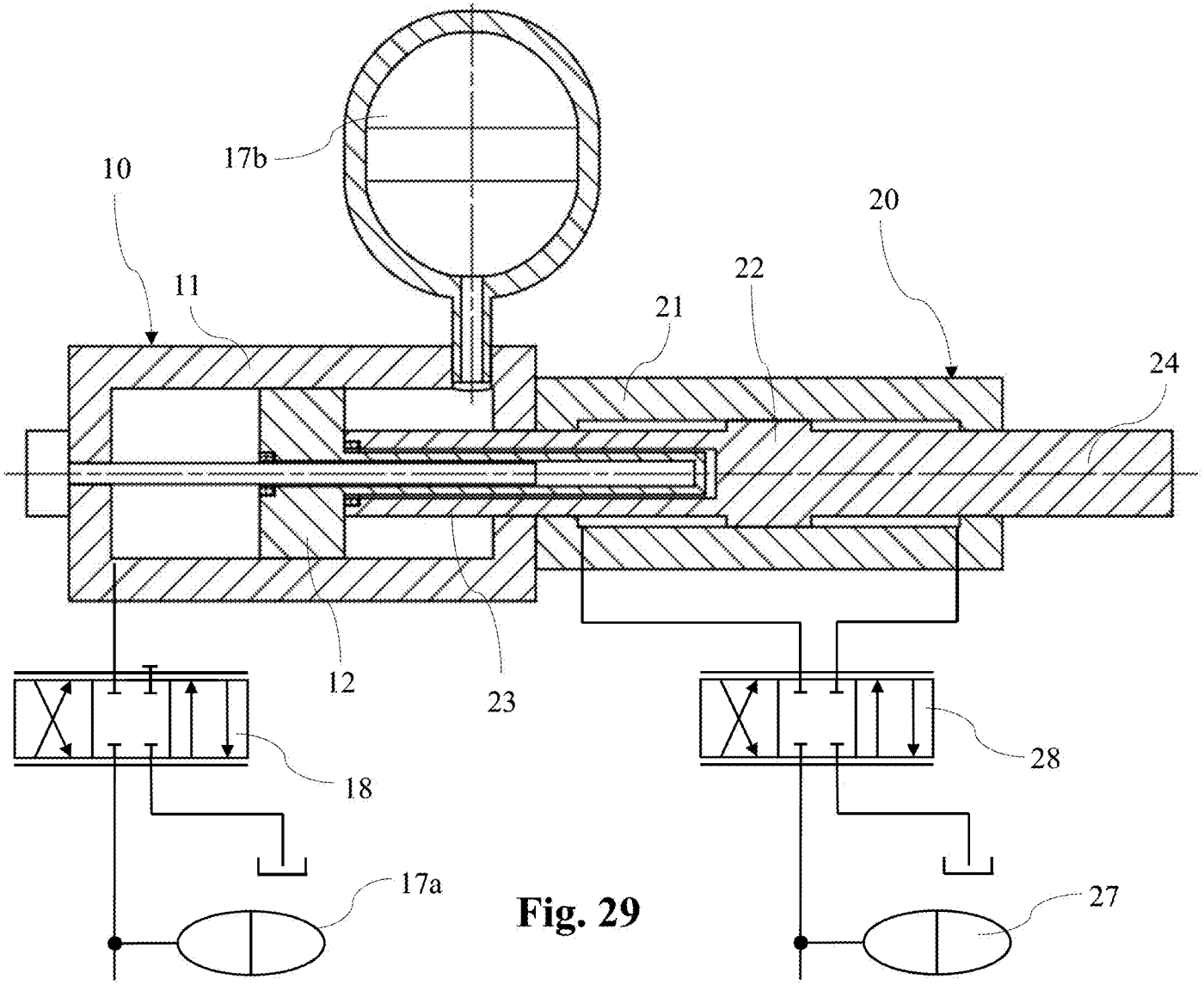
FIGS. 29-34—show the actuator device of FIG. 1 in various phases in the third application during the descaling and shaping of a shaped part, and an associated force-path-time diagram.
Figure 33:
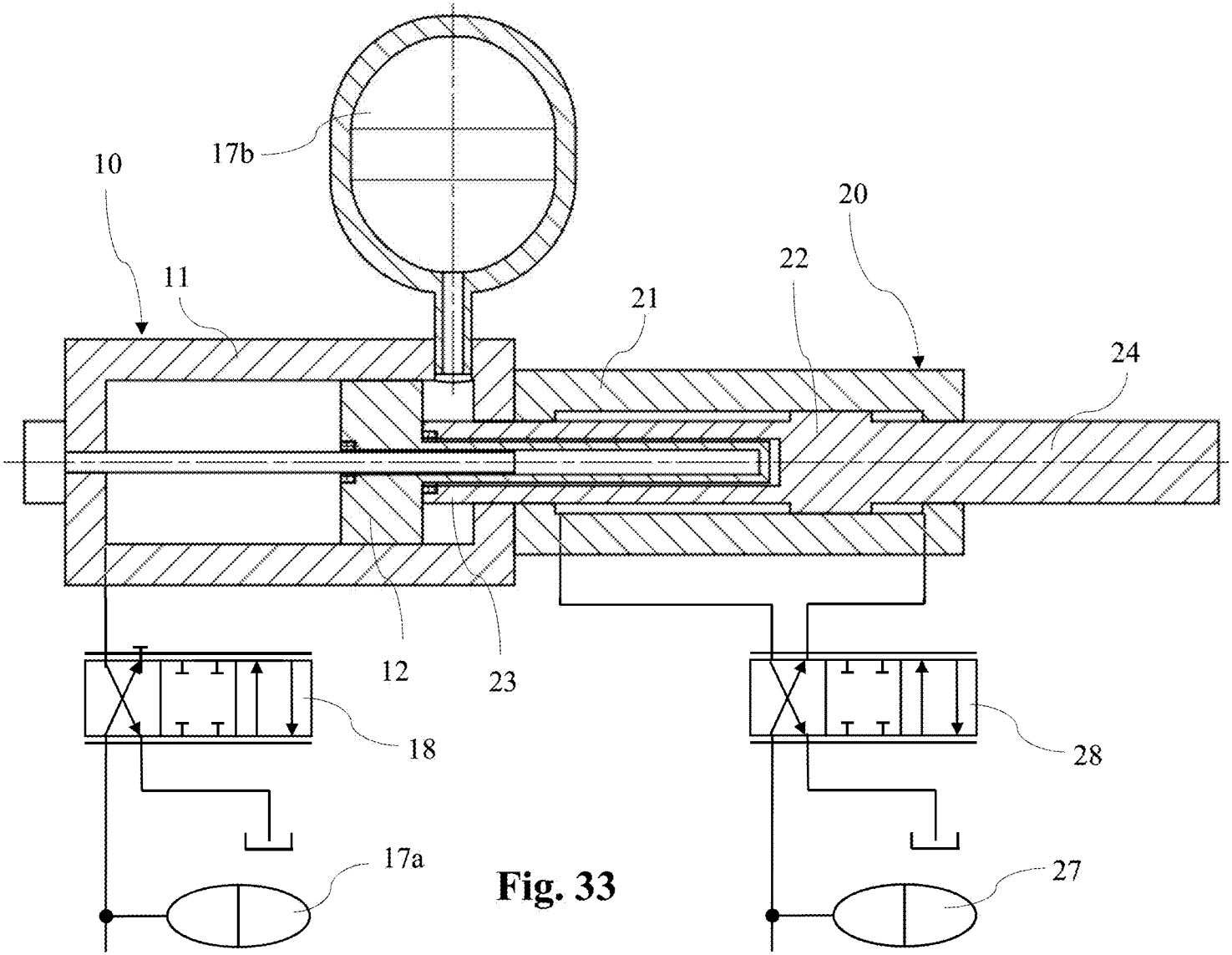

Next the forming process begins, wherein the punch 330 presses the blank U into the forming die 320 (FIG. 27), while the actuator output element moves into its starting position shown in FIG. 29 in a force- and position-controlled manner. While the blank U is being pressed into the forming die 320, the actuator output element 24 brakes the introduction movement of the blank in a force-controlled manner. FIG. 33 shows the actuator device in this braking phase.

Figure 28:
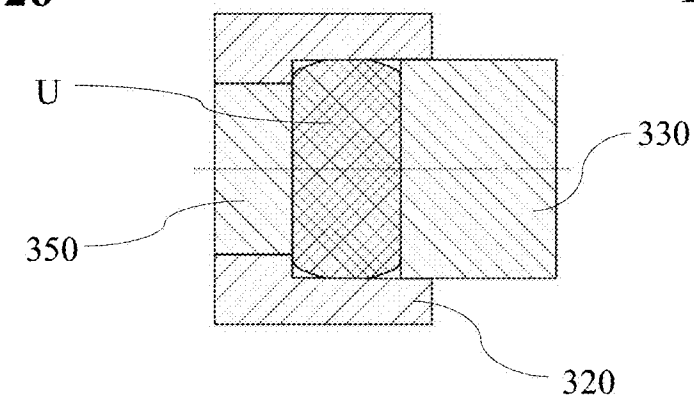

As soon as the actuator output element 24 and the two pistons 12 and 22 have reached their starting position, the actuator output element 24 opposes the inward movement of the blank with a large force, the blank then undergoing final shaping in the forming die by the punch (FIG. 28).

The forming device is then ready for a new process cycle.

Figure 34:
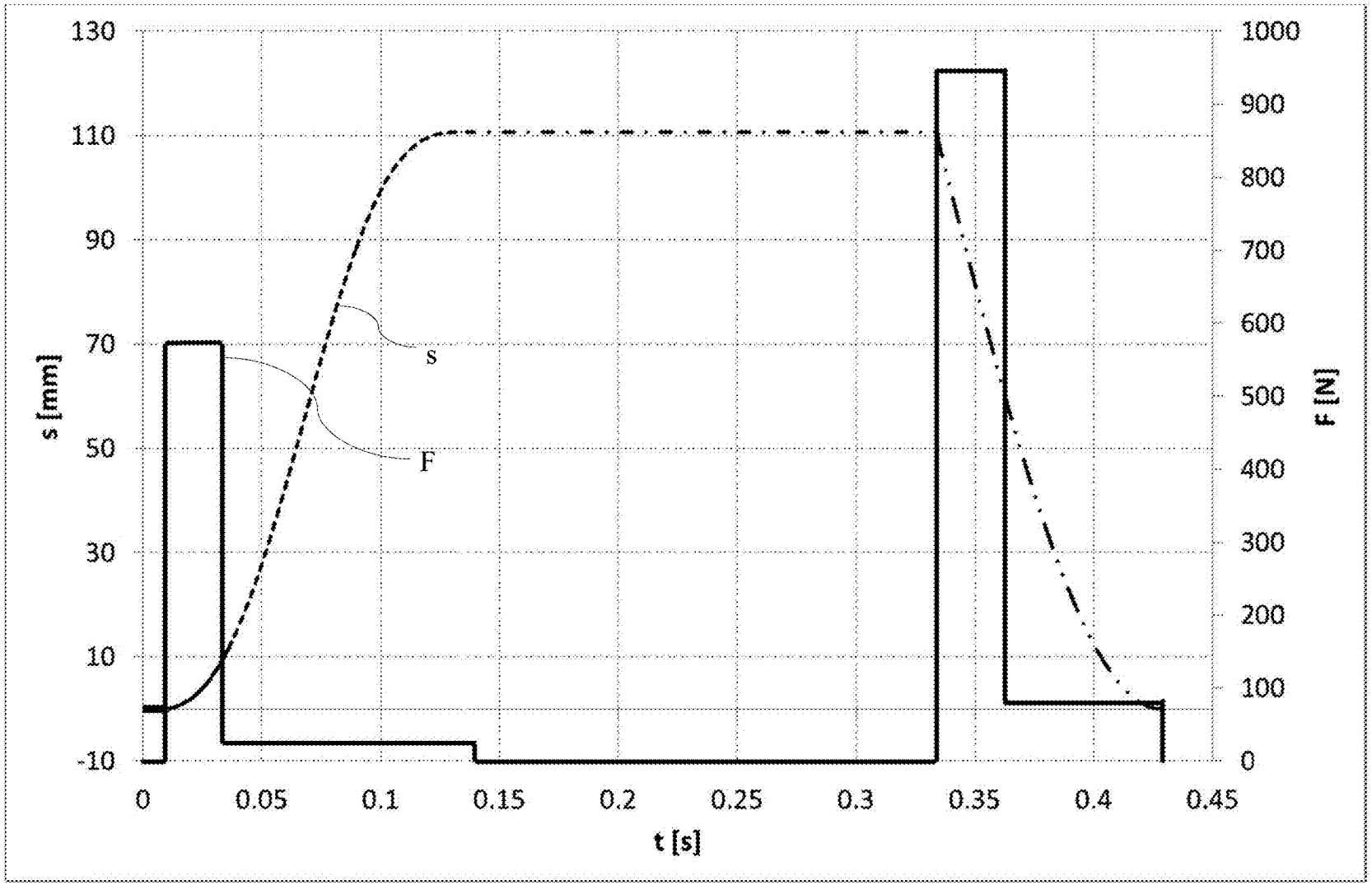

FIG. 34 shows the thrust force that arises during a descaling and forming cycle of the actuator device and that is to be applied by the device via the actuator output element 24 thereof and also the travel path (stroke length from the starting position) of the actuator output element 24 as a function of the cycle time t. The dashed line shows the travel path s, the solid line shows the force F.

Figure 36:
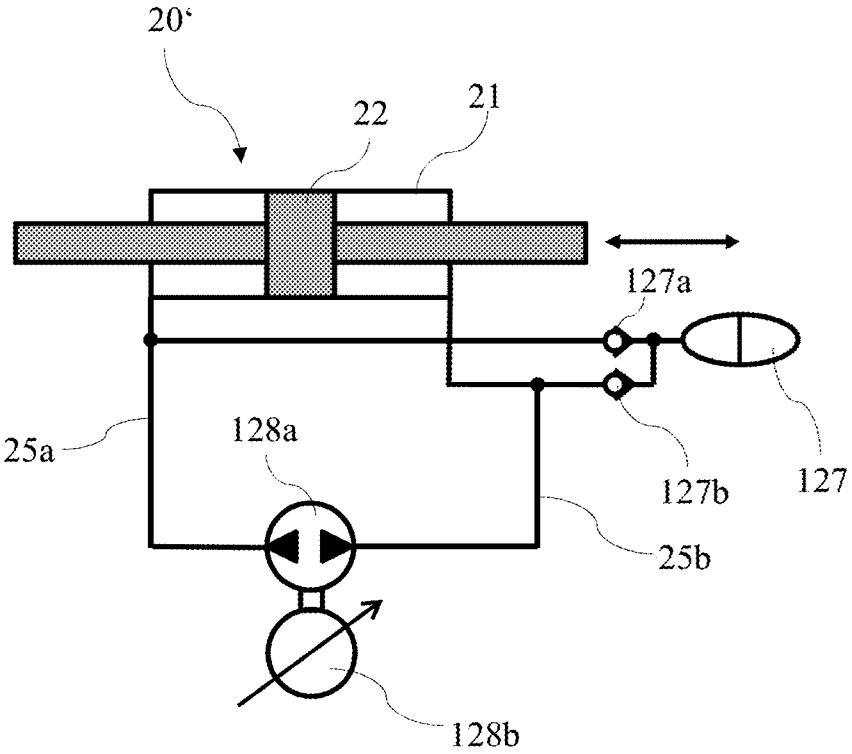
FIGS. 35-36—each show in diagrammatic form a variant of a detail of the actuator device.
Figure 35:
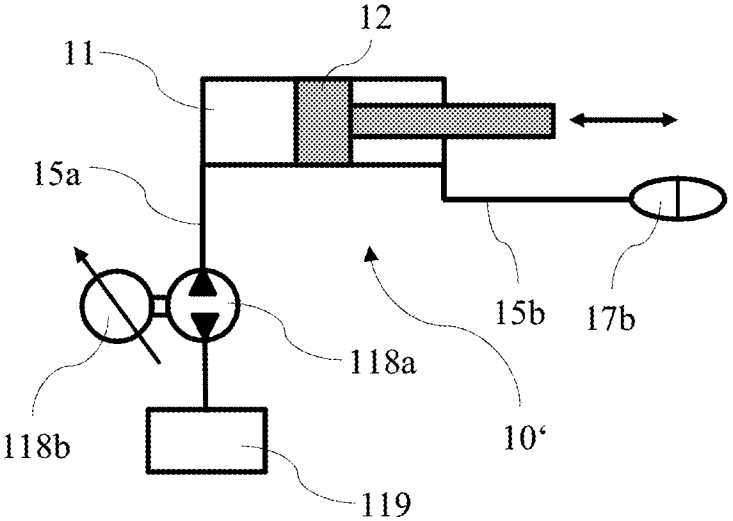

In the exemplary embodiments described above, the supply and discharge of hydraulic medium is effected by means of servo valves 18 and 28. FIGS. 35 and 36 show a variant of the first and second drive units in which speed-controlled pumps are used instead of servo valves.

In addition to the components already described, the drive unit 10' comprises a hydraulic tank 119 and a speed-controlled pump 118*a* driven by an electric servo motor 118*b*. The pump 118*a* is connected to the first piston chamber 11 via the line 15*a*.

In addition to the components already described, the second drive unit 20' comprises a speed-controlled pump 128*a* driven by an electric servo motor 128*b*. The pump 128*a* is connected to the second piston chamber 21 via the lines 25*a* and 25*b*. An additionally present diaphragm or bladder accumulator 127 is connected to the two lines 25*a* and 25*b* via a respective non-return valve 127*a* and 127*b*, respectively.

The two servo motors 118*b* and 128*b* (instead of the servo valves 18 and 28) are actuated by the controller 50.

The mode of operation of the two drive units is clear to the person skilled in the art and requires no further explanation.

The invention claimed is:

1. An actuator device for linear movement of an actuator output element along a movement axis having a first drive unit and a second drive unit, wherein the first drive unit has a first piston chamber and a first piston mounted so as to be linearly displaceable therein and also first hydraulic means for displacing the first piston in the first piston chamber, and wherein the second drive unit has the actuator output element which is linearly movable along the movement axis and which can be coupled to the first piston of the first drive unit for thrust, so that by movement of the first piston in an outward direction the actuator output element is likewise moved in the outward direction, wherein the second drive unit has a second piston chamber joined to the first piston chamber for conjoint movement therewith and a second piston mounted so as to be linearly displaceable in the second piston chamber and also second hydraulic or pneumatic means for displacing the second piston in the second piston chamber, the second piston being joined to the actuator output element for conjoint movement therewith, so that by movement of the second piston in the outward direction the actuator output element is movable out of the second piston chamber and by movement of the second piston in an inward direction opposite to the outward direction the actuator output element is movable into the second piston chamber, wherein the actuator device has a position-measuring device for detecting the positions of the first piston and the second piston relative to a reference position that is fixed with respect to the device for a position-controlled movement of the actuator output element.

2. The actuator device according to claim 1, wherein the first drive unit is configured to generate a larger thrust force than the second drive unit.

3. The actuator device according to claim 2, wherein the second drive unit is configured to accelerate and move the second piston more quickly than the first drive unit accelerates and moves the first piston.

4. The actuator device according to claim 2, wherein the actuator device has pressure sensors configured to detect the pressures in the first piston chamber and the second piston chamber of hydraulic or pneumatic medium located in the first piston chamber and the second piston chamber.

5. The actuator device according to claim 2, wherein the first drive unit has a bladder or diaphragm accumulator for resetting the first piston in the inward direction.

6. The actuator device according to claim 2, wherein the first drive unit has a gas accumulator for resetting the first piston in the inward direction.

7. The actuator device according to claim 2, wherein an impact element is joined to the second piston for conjoint movement therewith, and the second piston is displaceable in the outward direction by the first piston via the impact element.

8. The actuator device according to claim 1, wherein the second drive unit is configured to accelerate and move the second piston more quickly than the first drive unit accelerates and moves the first piston.

9. The actuator device according to claim 8, wherein the actuator device has pressure sensors configured to detect the pressures in the first piston chamber and the second piston chamber of hydraulic or pneumatic medium located in the first piston chamber and the second piston chamber.

10. The actuator device according to claim 1, wherein the actuator device has pressure sensors configured to detect the pressures in the first piston chamber and the second piston chamber of hydraulic or pneumatic medium located in the first piston chamber and the second piston chamber.

11. The actuator device according to claim 10, wherein the actuator device has a control device which co-operates with the position-measuring device and the pressure sensors for the purpose of position- and force-controlled movement of the first piston and the second piston.

12. The actuator device according to claim 11, wherein the actuator device has servo valves, which are arranged to be actuated by the control device and are configured for continuous operation, for supplying and discharging hydraulic or pneumatic medium to and from the first and second piston chambers.

13. The actuator device according to claim 11, wherein the actuator device has speed-controlled pumps, which are arranged to be actuated by the control device, for supplying and discharging hydraulic or pneumatic medium to and from the first and second piston chambers.

14. The actuator device according to claim 1, wherein the first drive unit has a bladder or diaphragm accumulator for resetting the first piston in the inward direction.

15. The actuator device according to claim 1, wherein the first drive unit has a gas accumulator for resetting the first piston in the inward direction.

16. The actuator device according to claim 1, wherein an impact element is joined to the second piston for conjoint movement therewith, and the second piston is displaceable in the outward direction by the first piston via the impact element.

17. A method for applying a directed force to a deformable material in a forming device comprising using the actuator device of claim 1.

18. The method of claim 17, further comprising ejecting the deformable material from a forming die by the actuator device.

19. The method of claim 17, further comprising, during a forming process, supporting the deformable material by the actuator device against the action of an external force.

20. The method of claim 17, wherein displacement of the deformable material brought about by the action of an external force is braked in a controlled way by the actuator device.

* * * * *